US007582171B2

(12) United States Patent
Gerster et al.

(10) Patent No.: US 7,582,171 B2
(45) Date of Patent: Sep. 1, 2009

(54) HIGH-STRENGTH, SOFT-MAGNETIC IRON-COBALT-VANADIUM ALLOY

(75) Inventors: Joachim Gerster, Alzenau (DE); Johannes Tenbrink, Mömbris (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 879 days.

(21) Appl. No.: 10/841,124

(22) Filed: May 7, 2004

(65) Prior Publication Data

US 2005/0268994 A1 Dec. 8, 2005

(30) Foreign Application Priority Data

May 7, 2003 (DE) ..... 103 20 350

(51) Int. Cl.
*H01F 1/147* (2006.01)

(52) U.S. Cl. ..... 148/315; 148/306; 148/310; 148/311; 148/313; 420/435; 420/581; 420/119; 420/127

(58) Field of Classification Search ..... None
See application file for complete search history.

(56) References Cited

U.S. PATENT DOCUMENTS

| | | | | |
|---|---|---|---|---|
| 3,634,072 | A | 1/1972 | Ackermann et at. | 75/122 |
| 4,116,727 | A | 9/1978 | Major | 148/31.55 |
| 4,933,026 | A | 6/1990 | Rawlings et al. | 148/311 |
| 5,501,747 | A | 3/1996 | Masteller et al. | 148/311 |
| 5,976,274 | A | 11/1999 | Inoue et al. | 148/304 |
| 6,146,474 | A | 11/2000 | Coutu et al. | 148/315 |
| 6,685,882 | B2 * | 2/2004 | Deevi et al. | 420/124 |
| 2002/0127132 | A1 | 9/2002 | Deevi et al. | 420/127 |

FOREIGN PATENT DOCUMENTS

| | | | | |
|---|---|---|---|---|
| DE | 69903202 T | | 11/2000 | |
| EP | 0824755 | | 11/1996 | |
| EP | 0935008 B1 | | 10/2002 | |
| GB | 1523881 | | 9/1978 | |
| JP | 59-162251 | * | 9/1984 | 148/302 |
| JP | 9228007 | | 9/1997 | |

OTHER PUBLICATIONS

R.V. Major et al., "High Saturation Ternary Cobalt-Iron Based Alloys", IEEE Transactions on Magnetics, vol. 24, No. 2, pp. 1856-1858, figures 1 and 2.

F. Pfeifer et al., "Soft Magnetic Ni-Fe and Co-Fe Alloys—Some Physical and Metallurgical Aspects", Journal of Magnetism and Magnetic Materials, vol. 19, pp. 190-207.

* cited by examiner

*Primary Examiner*—John P. Sheehan
(74) *Attorney, Agent, or Firm*—King & Spalding L.L.P.

(57) ABSTRACT

A high-strength, soft-magnetic iron-cobalt-vanadium alloy selection is proposed, consisting of 35.0≦Co≦55.0% by weight, 0.75≦V≦2.5% by weight, O≦Ta+2×Nb≦0.8% by weight, 0.3<Zr≦1.5% by weight, remainder Fe and melting-related and/or incidental impurities. This zirconium-containing alloy selection has excellent mechanical properties, in particular a very high yield strength, high inductances and particularly low coercive forces. It is eminently suitable for use as a material for magnetic bearings used in the aircraft industry.

23 Claims, 11 Drawing Sheets

HIGH-STRENGTH, SOFT-MAGNETIC IRON-COBALT-VANADIUM ALLOY

PRIORITY

This application claims foreign priority to German application number DE10320350.8 filed May 7, 2003.

TECHNICAL FIELD OF THE INVENTION

The invention relates to a high-strength, soft-magnetic iron-cobalt-vanadium alloy which can be used in particular for electrical generators, motors and magnetic bearings in aircraft. Electric generators, motors and magnetic bearings in aircraft, in addition to a small overall size, must also have the minimum possible weight. Therefore, soft-magnetic iron-cobalt-vanadium alloys which have a high saturation induction are used for these applications.

BACKGROUND OF THE INVENTION

The binary iron-cobalt alloys with a cobalt content of between 33 and 55% by weight are extraordinarily brittle, which is attributable to the formation of an ordered superstructure at temperatures below 730° C. The addition of approximately 2% by weight of vanadium impedes the transition to this superstructure, so that relatively good cold workability can be achieved after quenching to room temperature from temperatures of over 730° C.

Accordingly, a known ternary base alloy is an iron-cobalt-vanadium alloy which contains 49% by weight of iron, 49% by weight of cobalt and 2% by weight of vanadium. This alloy has long been known and is described extensively, for example, in "R. M. Bozorth, Ferromagnetism, van Nostrand, New York (1951)". This vanadium-containing iron-cobalt alloy is distinguished by its very high saturation induction of approx. 2.4 T.

A further development of this ternary vanadium-containing cobalt-iron base alloy is known from U.S. Pat. No. 3,634,072, which describes, during the production of alloy strips, quenching of the hot-rolled alloy strip from a temperature above the phase transition temperature of 730° C. This process is required in order to make the alloy sufficiently ductile for the subsequent cold rolling. The quenching suppresses the ordering. In manufacturing terms, however, the quenching is highly critical, since what are known as the cold-rolling passes can very easily cause fractures in the strips. Therefore, considerable efforts have been made to increase the ductility of the alloy strips and thereby to increase manufacturing reliability.

Therefore, U.S. Pat. No. 3,634,072 proposes, as ductility-increasing additives, the addition of 0.02 to 0.5% by weight of niobium and/or 0.07 to 0.3% by weight of zirconium.

Niobium, which incidentally may also be replaced by the homologous element tantalum, in the iron-cobalt alloying system, not only has the property of greatly reducing the degree of order, as has been described, for example, by R. V. Major and C. M. Orrock in "High saturation ternary cobalt-iron based alloys", IEEE Trans. Magn. 24 (1988), 1856-1858, but also inhibits grain growth.

The addition of zirconium in the quantity of at most 0.3% by weight proposed by U.S. Pat. No. 3,634,072 likewise inhibits grain growth. Both mechanisms significantly improve the ductility of the alloy after quenching.

In addition to this high-strength niobium- and zirconium-containing iron-cobalt-vanadium alloy which is known from U.S. Pat. No. 3,634,072, zirconium-free alloys are also known, from U.S. Pat. No. 5,501,747.

That document proposes iron-cobalt-vanadium alloys which are used in fast aircraft generators and magnetic bearings. U.S. Pat. No. 5,501,747 is based on the teaching of U.S. Pat. No. 3,364,072 and restricts the niobium content disclosed therein to 0.15-0.5% by weight. Furthermore, U.S. Pat. No. 5,501,747 recommends a special magnetic final anneal, in which the alloy can be heat-treated for no more than approximately four hours, preferably no more than two hours, at a temperature of no greater than 740° C., in order to produce an object which has a yield strength of at least approximately 620 MPa. This is very limiting and also very unusual, since the soft-magnetic iron-cobalt-vanadium alloys are normally annealed at temperatures of over 740° C. and below 900° C.

The magnetic and mechanical properties can be adjusted by means of the annealing temperature. Both properties are crucial for use of the alloys. However, it is very difficult to simultaneously optimize these two properties, since the properties are contradictory:

1. If the alloy is annealed at a relatively high temperature, the result is a coarser grain and therefore good soft-magnetic properties. However, the mechanical properties obtained are generally relatively poor.

2. On the other hand, if the alloy is annealed at lower temperatures, better mechanical properties are obtained, on account of a finer grain, but the finer grain results in worse magnetic properties.

A major drawback of the alloy selection disclosed by U.S. Pat. No. 5,501,747 is the need for the abovementioned rapid anneal, which may only be carried out for approximately one to two hours at a temperature close to the ordered/unordered phase boundary in order to achieve usable magnetic and mechanical properties.

If there is a very large quantity of material to be annealed, reliable production can therefore only be realized with very great difficulty, on account of different heat-up times and on account of temperature fluctuations within the material to be annealed. On a large industrial scale, the result is generally unacceptable scatters with regard to the yield strengths which are characteristic of the mechanical properties.

SUMMARY OF THE INVENTION

Therefore, it is an object of the present invention to provide a new high-strength, soft-magnetic iron-cobalt-vanadium alloy selection which is distinguished by very good mechanical properties, in particular by very high yield strengths.

Furthermore, the alloys should have yield strengths of over 600 MPa, preferably of over 700 MPa, even with longer annealing times of at least two hours and with a high manufacturing reliability.

Furthermore, the alloys should at the same time have high saturation inductances and the lowest possible coercive forces, i.e. should have excellent soft-magnetic properties.

According to the invention, this object is achieved by a soft-magnetic iron-cobalt-vanadium alloy selection which substantially comprises $35.0 \leqq Co \leqq 55.0\%$ by weight, $0.75 \leqq V \leqq 2.5\%$ by weight, $0 \leqq (Ta+2\times Nb) \leqq 0.8\%$ by weight, $0.3 < Zr \leqq 1.5\%$ by weight, $Ni \leqq 5.0\%$ by weight, remainder Fe and melting-related and/or incidental impurities.

In this context and in the text which follows, the term "substantially comprises" is to be understood as meaning that the alloy selection according to the invention, in addition to the main constituents indicated, namely Co, V, Zr, Nb, Ta and Fe, may only include melting-related and/or incidental impurities in a quantity which has no significant adverse effect on either the mechanical properties or the magnetic properties.

Entirely surprisingly, it has emerged that iron-cobalt-vanadium alloys with zirconium contents of over 0.3% by weight have significantly better mechanical properties, while at the same time achieving excellent magnetic properties, than the prior art alloys described in the introduction.

This can be attributed to the fact that, on account of the addition of zirconium in quantities greater than 0.3% by weight, a previously unknown hexagonal Laves phase is formed within the microstructure between the individual grains, and this has a very positive effect on the mechanical and magnetic properties. This hexagonal Laves phase should not be confused, in terms of its metallurgy and crystallography, with the cubic Laves phase described in U.S. Pat. No. 5,501,747. Only the name is partially identical. This significant addition of zirconium results in a significant improvement in ductility, in particular when used in conjunction with niobium and/or tantalum.

BRIEF DESCRIPTION OF THE DRAWINGS

In the text which follows, comparative examples and exemplary embodiments of the present invention are explained in detail with reference to Tables 1 to 33 and FIGS. 1 to 15, in which:

Table 1 shows properties of special melts from batches 93/5964 to 93/6018 after final annealing for one hour at 720° C. under $H_2$;

Figure 1:
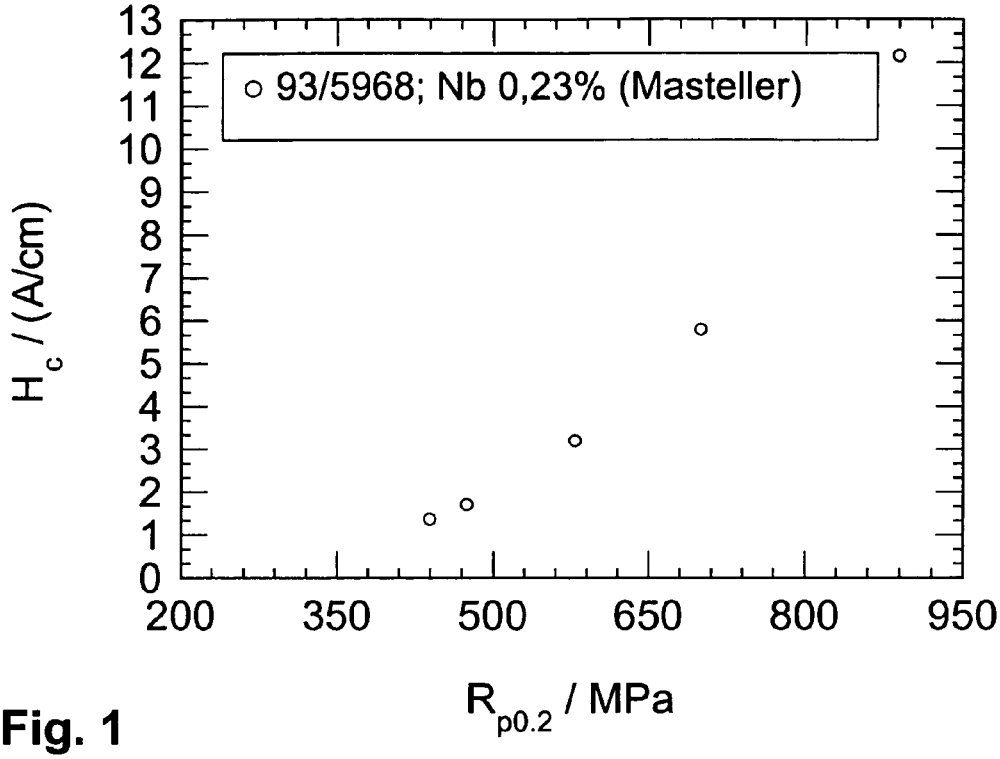
Fig. 1 Prior Art
Figure 2:
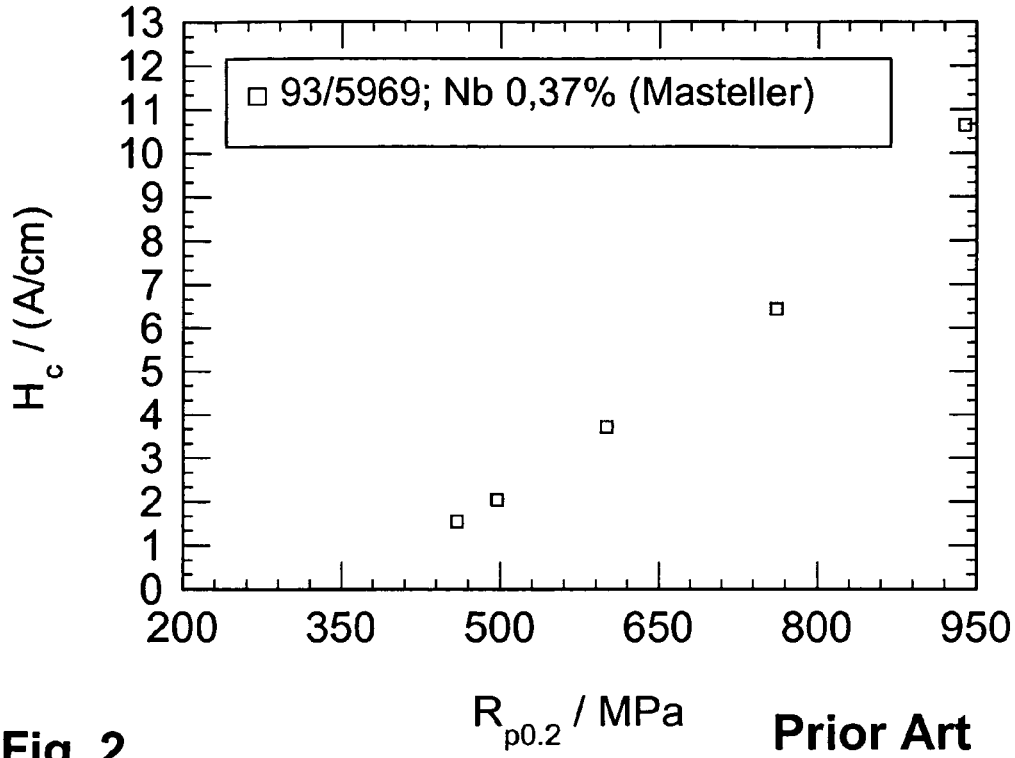
Fig. 2 Prior Art
Figure 3:
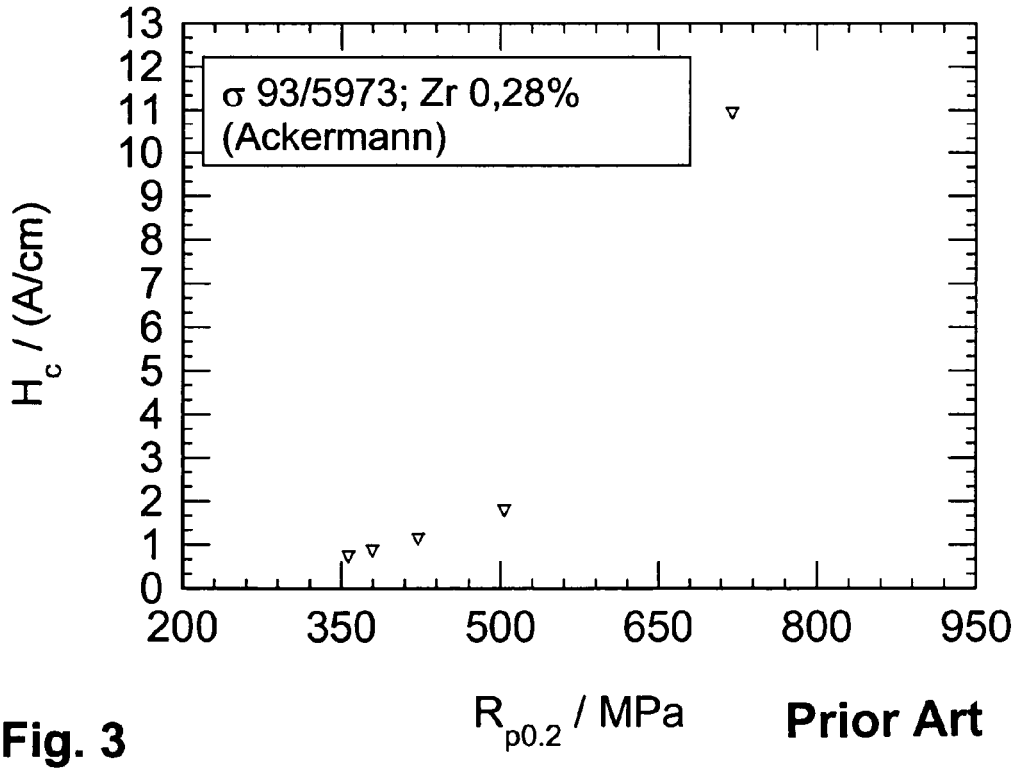
Fig. 3 Prior Art
Figure 4:
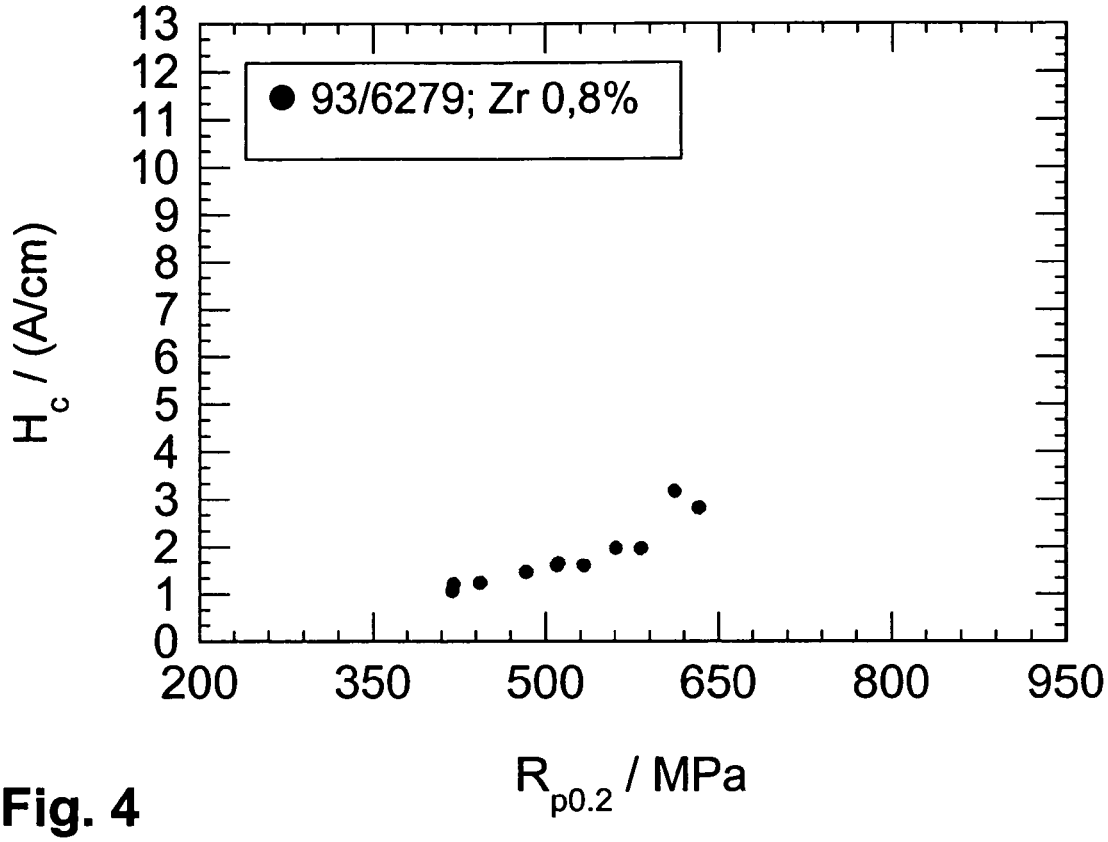
Figure 5:
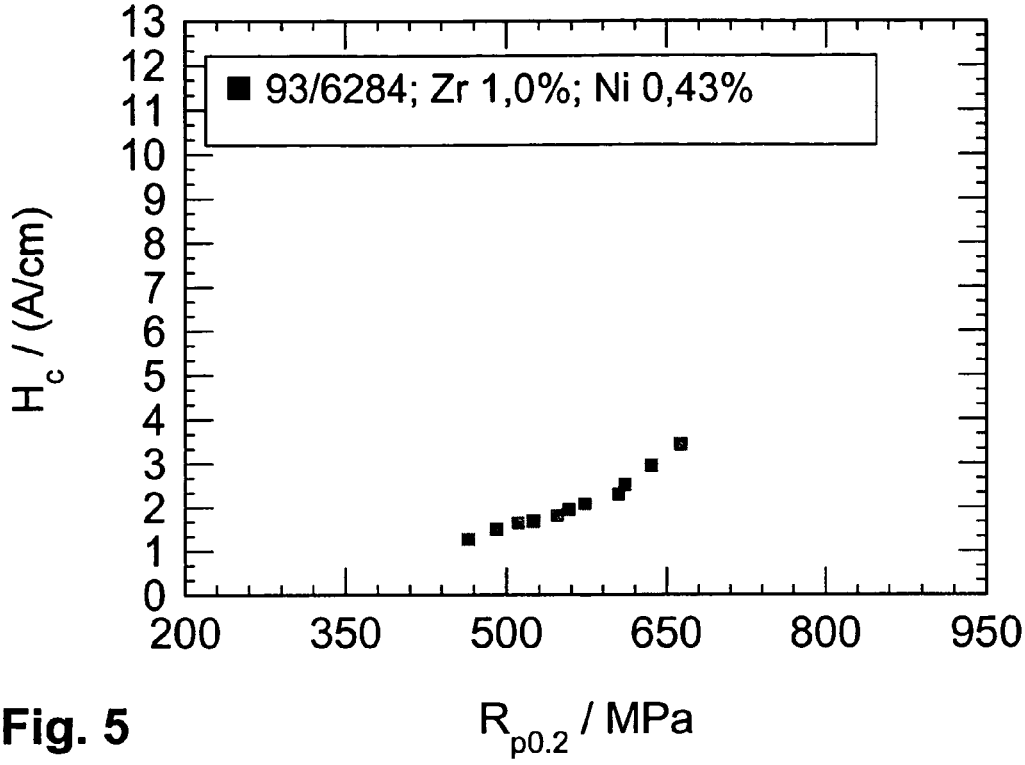
Figure 6:
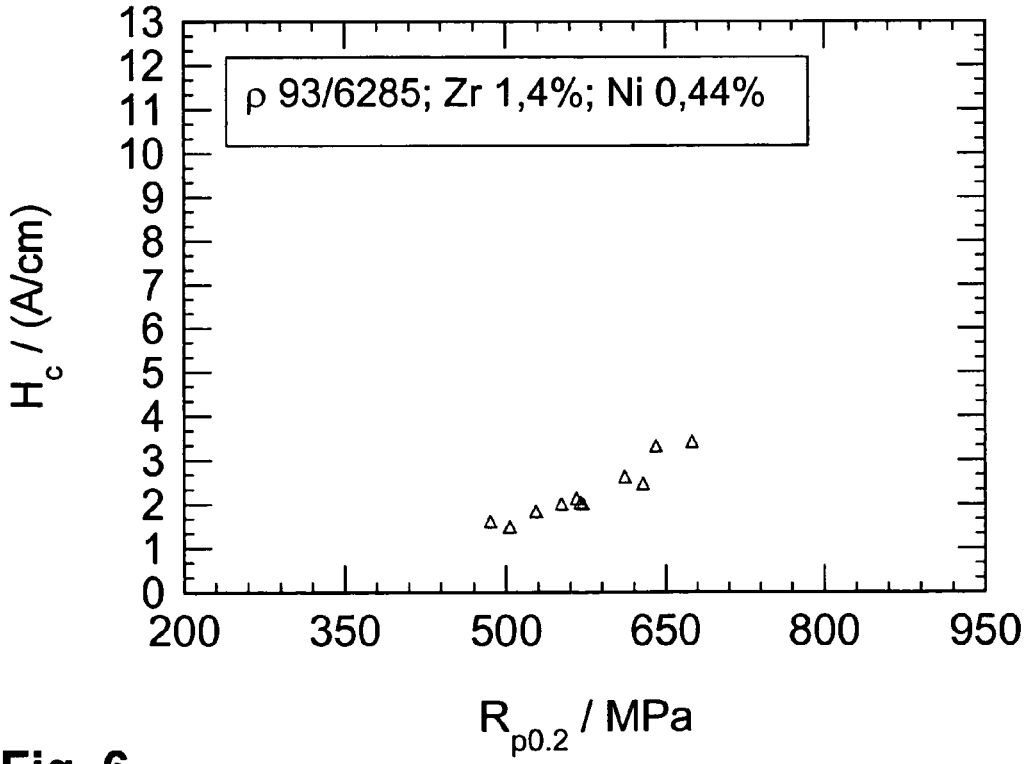
Figure 7:
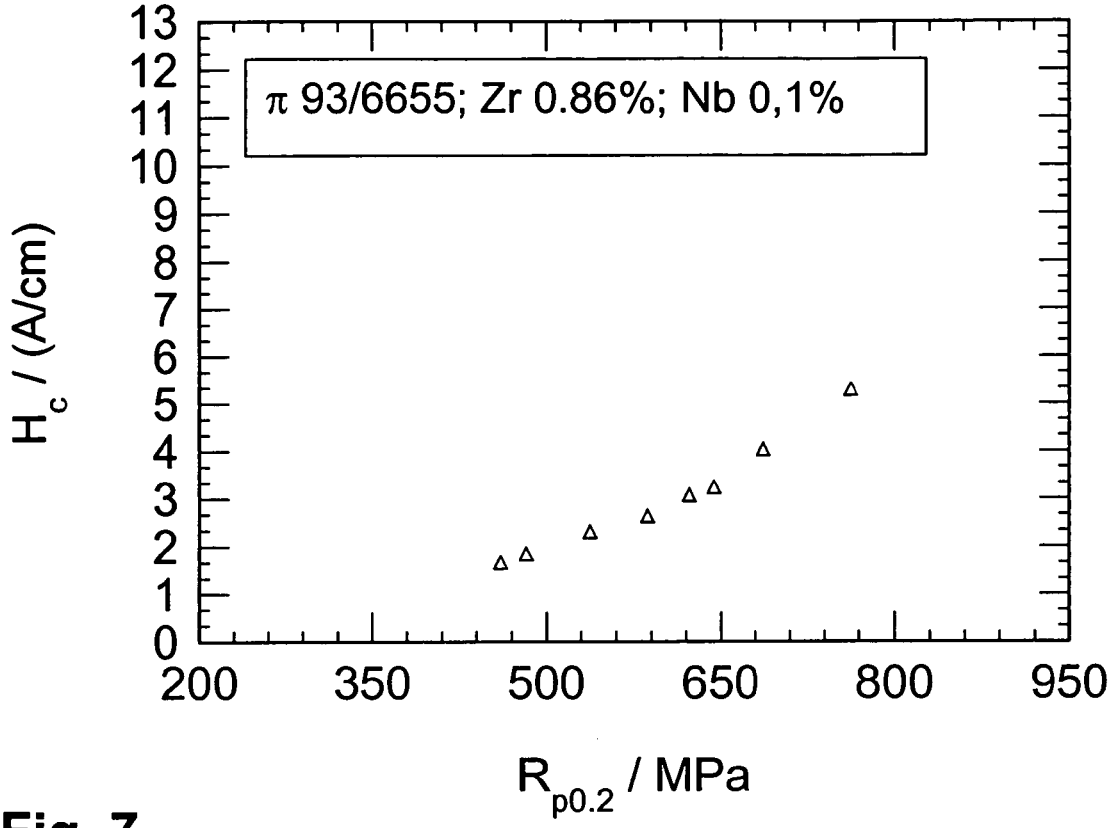
Figure 8:
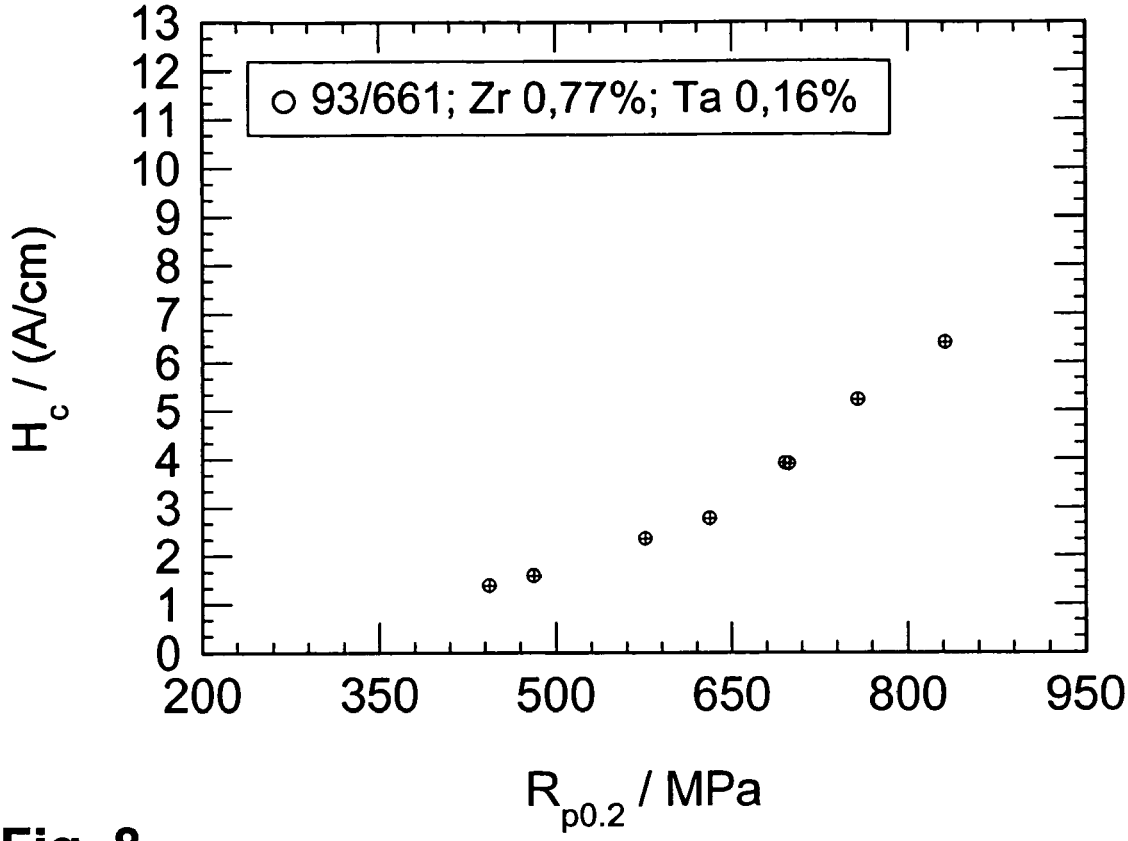
Figure 9:
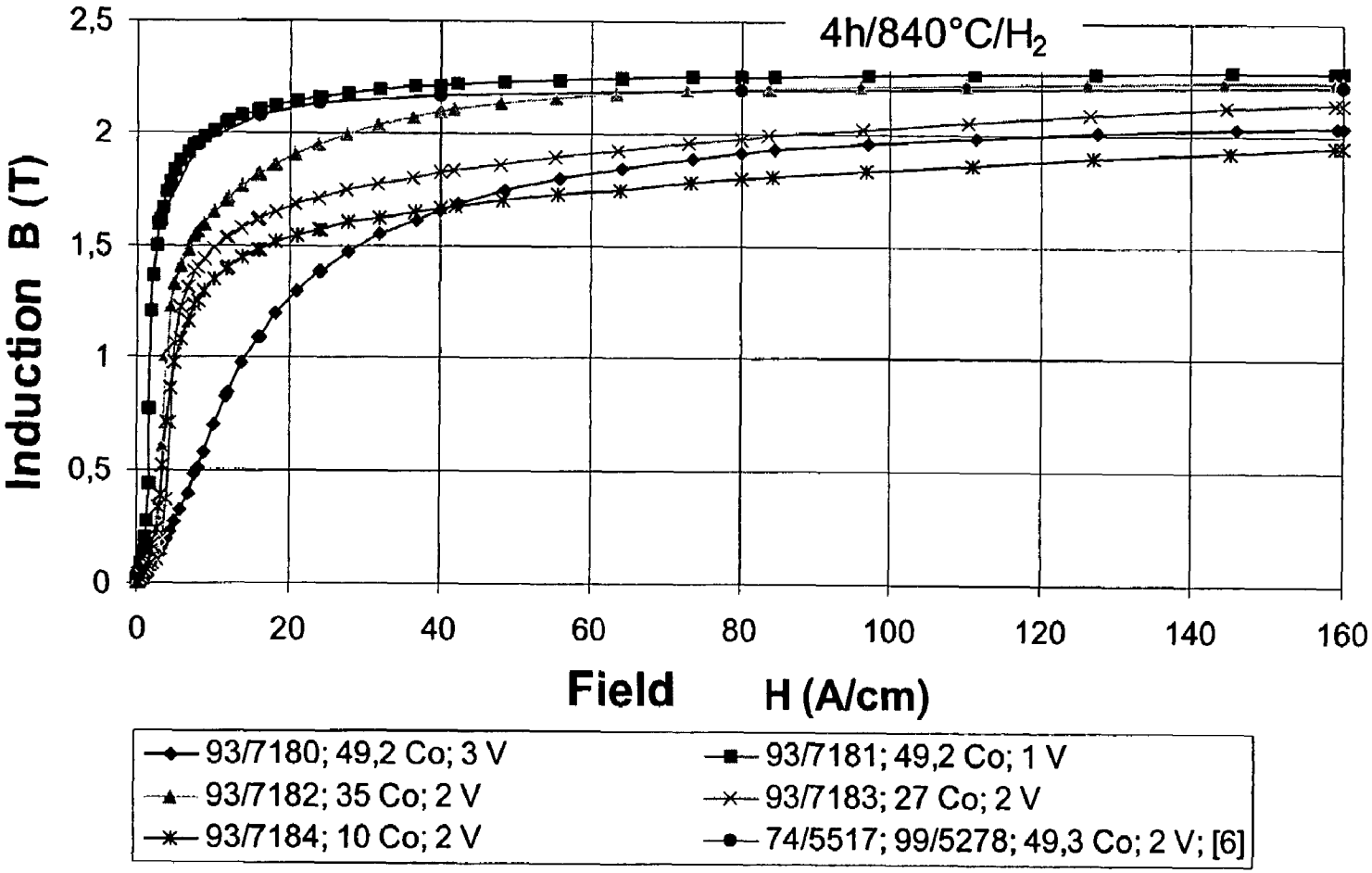
Figure 10:
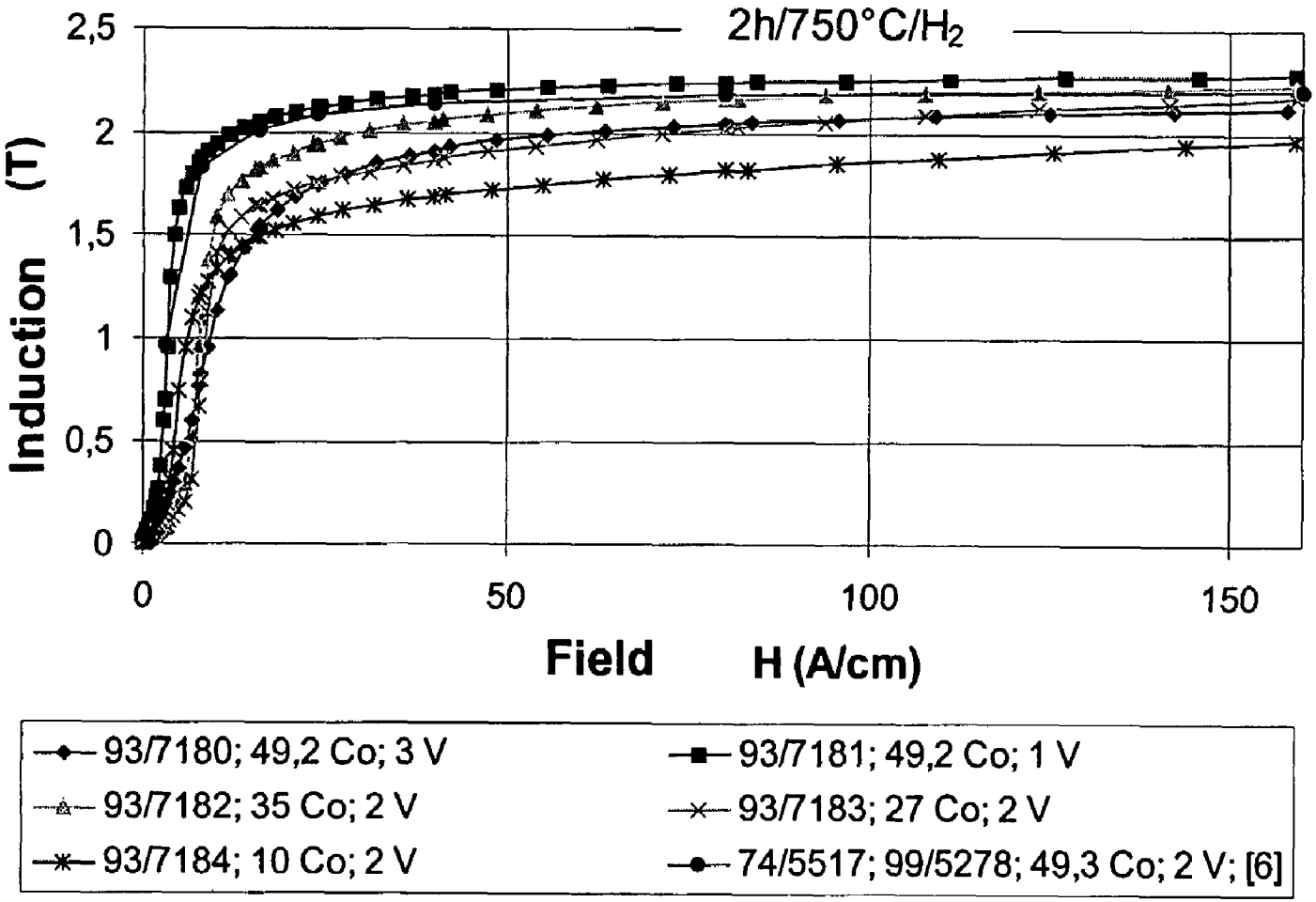
Figure 11:
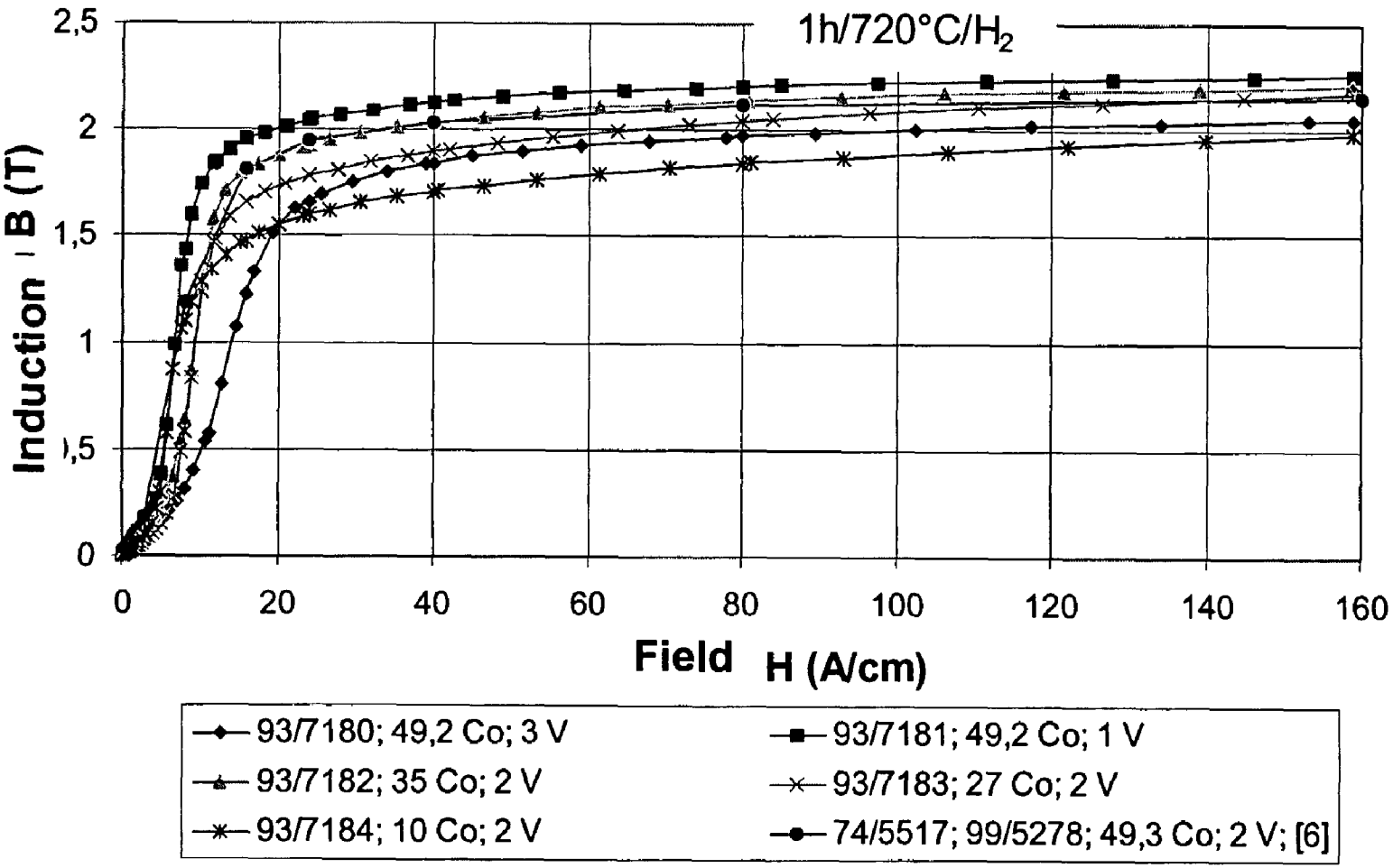
Figure 12:
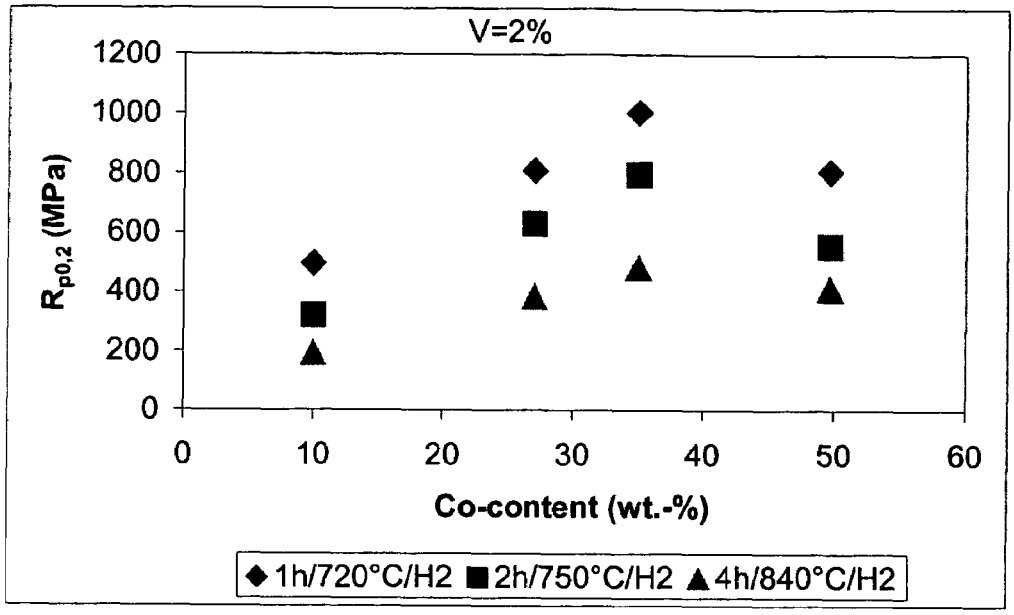
Figure 13:
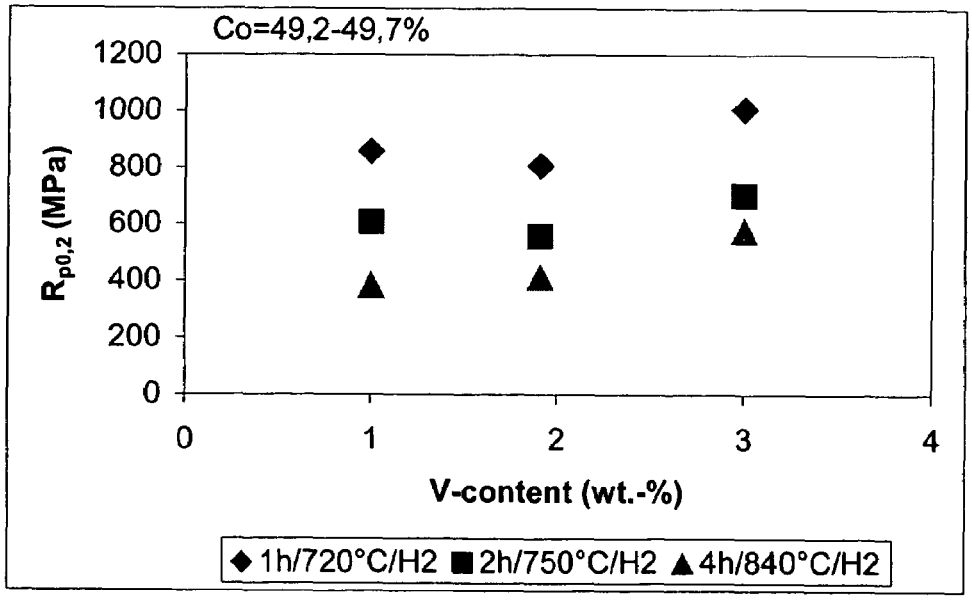
Figure 14:
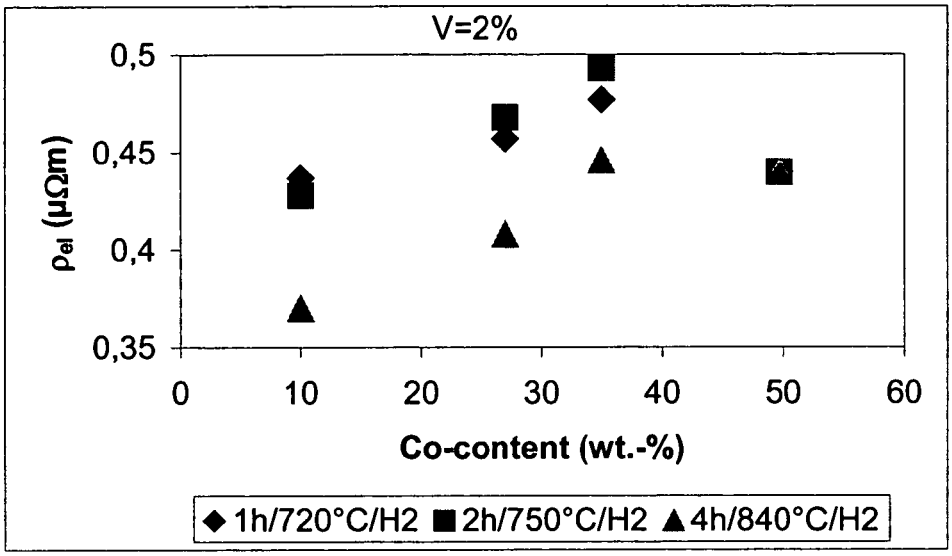
Figure 15:
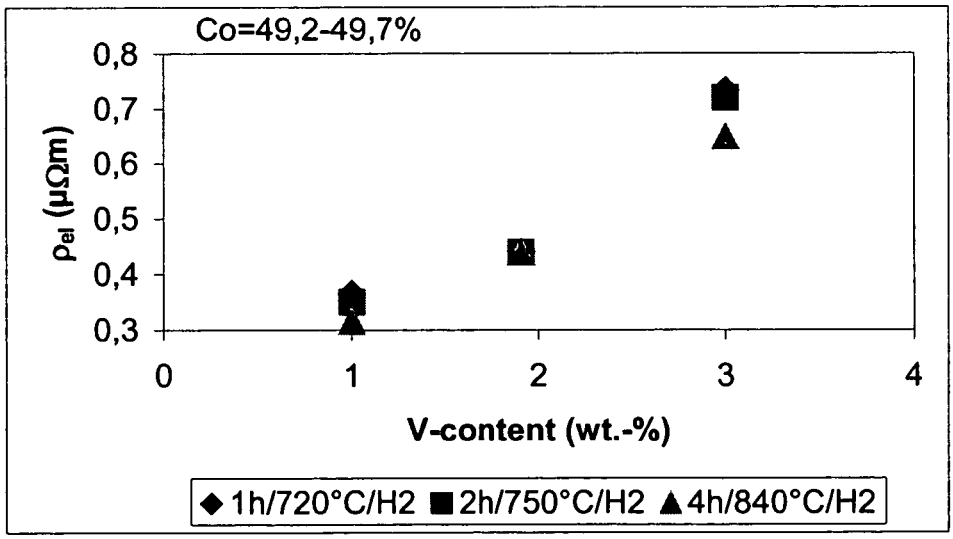

Table 2 shows properties of special melts from batches 93/6278 to 93/6289 after final annealing for one hour at 720° C. under $H_2$;

Table 3 shows properties of special melts from batches 93/6655 to 93/6666 after final annealing for one hour at 720° C. under $H_2$;

Table 4 shows properties of special melts from batches 93/5964 to 93/6018 after final annealing for two hours at 720° C. under $H_2$;

Table 5 shows properties of special melts from batches 93/6278 to 93/6289 after final annealing for two hours at 720° C. under $H_2$;

Table 6 shows properties of special melts from batches 93/6655 to 93/6666 after final annealing for two hours at 720° C. under $H_2$;

Table 7 shows properties of special melts from batches 93/6278 to 93/6289 after final annealing for four hours at 720° C. under $H_2$;

Table 8 shows properties of special melts from batches 93/6655 to 93/6666 after final annealing for four hours at 720° C. under $H_2$;

Table 9 shows properties of special melts from batches 93/6278 to 93/6289 after final annealing for one hour at 730° C. under $H_2$;

Table 10 shows properties of special melts from batches 93/6278 to 93/6289 after final annealing for two hours at 730° C. under $H_2$;

Table 11 shows properties of special melts from batches 93/6278 to 93/6289 after final annealing for one hour at 740° C. under $H_2$;

Table 12 shows properties of special melts from batches 93/6655 to 93/6666 after final annealing for one hour at 740° C. under $H_2$;

Table 13 shows properties of special melts from batches 93/6278 to 93/6289 after final annealing for two hours at 740° C. under $H_2$;

Table 14 shows properties of special melts from batches 93/6655 to 93/6666 after final annealing for two hours at 740° C. under $H_2$;

Table 15 shows properties of special melts from batches 93/5964 to 93/6018 after final annealing for four hours at 740° C. under $H_2$;

Table 16 shows properties of special melts from batches 93/6278 to 93/6306 after final annealing for four hours at 740° C. under $H_2$;

Table 17 shows properties of special melts from batches 93/6655 to 93/6666 after final annealing for four hours at 740° C. under $H_2$;

Table 18 shows properties of special melts from batches 93/6278 to 93/6289 after final annealing for one hour at 750° C. under $H_2$;

Table 19 shows properties of special melts from batches 93/6278 to 93/6289 after final annealing for one hour at 770° C. under $H_2$;

Table 20 shows properties of special melts from batches 93/6278 to 93/6289 after final annealing for two hours at 770° C. under $H_2$;

Table 21 shows properties of special melts from batches 93/5964 to 93/6018 after final annealing for four hours at 770° C. under $H_2$;

Table 22 shows properties of special melts from batches 93/6278 to 93/6284 after final annealing for four hours at 770° C. under $H_2$;

Table 23 shows properties of special melts from batches 93/6655 to 93/6666 after final annealing for four hours at 770° C. under $H_2$;

Table 24 shows properties of special melts from batches 93/5964 to 93/6018 after final annealing for four hours at 800° C. under $H_2$;

Table 25 shows properties of special melts from batches 93/6278 to 93/6306 after final annealing for four hours at 800° C. under $H_2$;

Table 26 shows properties of special melts from batches 93/6655 to 93/6666 after final annealing for four hours at 800° C. under $H_2$;

Table 27 shows the microstructural state of special melts 93/7179 to 93/7183 after quenching from various temperatures;

Table 28 shows properties of batches 93/7180 to 93/7184 and 74/5517 and 99/5278 after final annealing for one hour at 720° C. under $H_2$, thickness: 0.35 mm;

Table 29 shows hysteresis losses for special melts from batches 93/7180 to 93/7184 and 74/5517 and 99/5278 for various degrees of saturation and frequencies after final annealing for one hour at 720° C. under $H_2$, thickness 0.35 mm;

Table 30 shows properties of batches 93/7180 to 93/7184 and 74/5517 and 99/5278 after final annealing for two hours at 750° C. under $H_2$, thickness: 0.35 mm;

Table 31 shows hysteresis losses for special melts from batches 93/7180 to 93/7184 and 74/5517 and 99/5278 for various degrees of saturation and frequencies after final annealing for two hours at 750° C. under $H_2$, thickness 0.35 mm;

Table 32 shows properties of batches 93/7180 to 93/7184 and 74/5517 and 99/5278 after final annealing for four hours at 840° C. under $H_2$, thickness: 0.35 mm;

Table 33 shows hysteresis losses for special melts from batches 93/7180 to 93/7184 and 74/5517 and 99/5278 for various degrees of saturation and frequencies after final annealing for four hours at 840° C. under $H_2$, thickness: 0.35 mm;

FIG. 1 is a graph summarizing properties of a prior art alloy 93/5968 (Masteller);

FIG. 2 is a graph summarizing properties of a prior art alloy 93/5969 (Masteller);

FIG. 3 is a graph summarizing properties of a prior art alloy 93/5973 (Ackermann);

FIG. 4 is a graph summarizing properties of an exemplary alloy 93/6279 of the present invention;

FIG. 5 is a graph summarizing properties of an exemplary alloy 93/6284 of the present invention;

FIG. 6 is a graph summarizing properties of an exemplary alloy 93/6285 of the present invention;

FIG. 7 is a graph summarizing properties of an exemplary alloy 93/6655 of the present invention;

FIG. 8 is a graph summarizing properties of an exemplary alloy 93/6661 of the present invention;

FIGS. 9-11 show the relationship between induction and field strength for exemplary embodiments of the alloy of the present invention 93/7180 to 93/7184;

FIGS. 12-13 show the relationship between Co content and V content and yield strength $R_{p0.2}$; and FIGS. 14-15 show the relationship between resistivity $\rho_{e1}$ and Co and V content for various annealing parameters.

DETAILED DESCRIPTION OF THE PREFERRED EMBODIMENTS OF THE INVENTION

In a preferred embodiment, the soft-magnetic iron-cobalt-vanadium alloy according to the invention has a zirconium content of $0.5 \leqq Zr \leqq 1.0\%$ by weight, ideally a zirconium content of $0.6 \leqq Zr \leqq 0.8\%$ by weight.

The cobalt content is typically $48.0 \leqq Co \leqq 50.0\%$ by weight. However, very good results can also be achieved with alloys with a cobalt content of between $45.0 \leqq Co \leqq 48.0\%$ by weight. The nickel content should be $Ni \leqq 1.0\%$ by weight, ideally $Ni \leqq 0.5\%$ by weight.

In one typical configuration of the present invention, the soft-magnetic iron-cobalt-vanadium alloy according to the invention has a vanadium content of $1.0 \leqq V \leqq 2.0\%$ by weight, ideally a vanadium content of $1.5 \leqq V \leqq 2.0\%$ by weight.

To achieve particularly good ductilities, the present invention provides for niobium and/or tantalum contents of $0.04 \leqq (Ta+2\times Nb) \leqq 0.8\%$ by weight, ideally of $0.04 \leqq (Ta+2\times Nb) \leqq 0.3\%$ by weight.

The soft-magnetic high-strength iron-cobalt-vanadium alloys according to the invention also have a content of melting-related and/or incidental metallic impurities of:

$Cu \leqq 0.2$, $Cr \leqq 0.3$, $Mo \leqq 0.3$, $Si \leqq 0.5$, $Mn \leqq 0.3$ and $Al \leqq 0.3$; preferably of:

$Cu \leqq 0.1$, $Cr \leqq 0.2$, $Mo \leqq 0.2$, $Si \leqq 0.2$, $Mn \leqq 0.2$ and $Al \leqq 0.2$; ideally of:

$Cu \leqq 0.06$, $Cr \leqq 0.1$, $Mo \leqq 0.1$, $Si \leqq 0.1$ and $Mn \leqq 0.1$.

Furthermore, nonmetallic impurities are typically present in the following ranges:

$P \leqq 0.01$, $S \leqq 0.02$, $N \leqq 0.005$, $O \leqq 0.05$ and $C \leqq 0.05$; preferably in the following ranges:

$P \leqq 0.005$, $S \leqq 0.01$, $N \leqq 0.002$, $O \leqq 0.02$ and $C \leqq 0.02$; ideally in the following ranges:

$S \leqq 0.005$, $N \leqq 0.001$, $O \leqq 0.01$ and $C \leqq 0.01$.

The alloys according to the invention can be melted by means of various processes. In principle, all conventional techniques, such as for example melting in air or production by vacuum induction melting (VIM), are possible.

However, the VIM process is preferred for production of the soft-magnetic iron-cobalt-vanadium alloys according to the invention, since the relatively high zirconium contents can be set more successfully. In the case of melting in air, zirconium-containing alloys have high melting losses, with the result that undesirable zirconium oxides and other impurities are formed. Overall, the zirconium content can be set more successfully if the VIM process is used.

The alloy melt is then cast into chill molds. After solidification, the ingot is desurfaced and then rolled into a slab at a temperature of between 900° C. and 1300° C.

As an alternative, it is also possible to do without the step of desurfacing the oxide skin on the surface of the ingots. Instead, the slab then has to be machined accordingly at its surface.

The resulting slab is then hot-rolled at similar temperatures, i.e. at temperatures above 900° C., to a strip. The hot-rolled alloy strip then obtained is too brittle for a further cold-rolling process. Accordingly, the hot-rolled alloy strip is quenched from a temperature above the ordered/unordered phase transition, which is known to be a temperature of approximately 730° C., in water, preferably in iced brine.

This treatment makes the alloy strip sufficiently ductile. After the oxide skin on the alloy strip has been removed, for example by pickling or blasting, the alloy strip is cold-rolled, for example to a thickness of approximately 0.35 mm.

Then, the desired shapes are produced from the cold-rolled alloy strip. This shaping operation is generally carried out by punching. Further processes include laser cutting, EDM, water jet cutting or the like.

After this treatment, the important magnetic final anneal is carried out, it being possible to precisely set the magnetic properties and mechanical properties of the end product by varying the annealing time and the annealing temperature.

The invention is explained below on the basis of exemplary embodiments and comparative examples. The differences between the individual alloys in terms of their mechanical and magnetic properties are explained with reference to FIGS. 1 to 8, which each show the coercive force $H_c$ as a function of the yield strength $R_{p0.2}$.

All the exemplary embodiments and all the comparative examples were produced by casting melts into flat chill molds under vacuum. The oxide skin present on the ingots was then removed by milling.

Then, the ingots were hot-rolled at a temperature of 1150° C. together with a thickness of d=3.5 mm.

The resulting slabs were then quenched in ice water from a temperature T=930° C. The quenched, hot-rolled slabs were finally cold-rolled to a thickness d'=0.35 mm. Then, tensile specimens and rings were punched out. The respective magnetic final anneals were carried out on the rings and tensile specimens obtained.

All the alloy parameters, magnetic measurement results and mechanical measurement results are reproduced in Tables 1 to 26.

To investigate the mechanical properties, tensile tests were carried out, in which the modulus of elasticity E, the yield strength $R_{p0.2}$, the tensile strength $R_m$, the elongation at break $A_L$ and the hardness HV were measured. The yield strength $R_{p0.2}$ was considered the most important mechanical parameter in this context.

The magnetic properties were tested on the punched rings. The static B-H initial magnetization curve and the static coercive force $H_c$ of the punched rings were determined.

COMPARATIVE EXAMPLES

Alloy in accordance with the prior art were produced under designations batches 93/5973 and under designations batch 93/5969 and 93/5968. Batch 93/5973 corresponds to an alloy as described in U.S. Pat. No. 3,634,072 (Ackermann), as cited in the introduction, i.e. a high-strength, soft-magnetic iron-cobalt-vanadium alloy with a low level of added zirconium of less than 0.3% by weight.

The precise amount of zirconium added was 0.28% by weight.

Batches 93/5969 and 93/5968 were alloys corresponding to U.S. Pat. No. 5,501,747 (Masteller), cited in the introduction. These were high-strength, soft-magnetic iron-cobalt-vanadium alloys without any zirconium.

The properties of these alloys are given in Tables 1, 4, 15, 21 and 24. These tables reproduce the properties of the molten alloys with various final anneals. The duration of the final anneals and the annealing temperatures were varied. The annealing temperatures were varied from 720° C. to 800° C. The duration of the final anneals was varied from one hour to four hours.

A graph summarizing the results found for these three alloys from the prior art is given in FIGS. 1, 2 and 3. As can be seen from these figures, with these alloys a high yield strength, i.e., a yield strength $R_{p0.2}$ of over 700 MPa, can only be achieved if significant losses in the soft-magnetic properties are accepted. All three alloys have a semihard-magnetic behavior, i.e. a coercive force $H_c$ of more than 6.0 A/cm, in the range of 700 MPa and above.

Exemplary Embodiments:

As exemplary embodiments according to the present invention, five different alloy batches were produced, listed under batch designations 93/6279, 93/6284, 93/6285, 93/6655 and 93/6661 in Tables 2, 3, 5, 6, 7, 8, 9, 10, 11, 12, 13, 14, 16, 17, 22, 23, 25 and 26.

In these alloys, firstly the zirconium content was varied, and secondly the zirconium content together with the other alloying constituents niobium and tantalum that are responsible for the ductility were varied.

With these alloy batches too, both the annealing temperatures for the magnetic final anneals and the final annealing times were varied. The final annealing times were varied between one hour and four hours. The final annealing temperatures were varied between 720° and 800° C.

A graph summarizing the individual results is given in FIGS. 4 to 8. These figures also show the coercive force $H_c$ as a function of the yield strength $R_{p0.2}$. Unlike with the alloys from the prior art, which have been discussed above under the Comparative Examples, the alloys according to the present invention have very high yield strengths combined, at the same time, with very good soft-magnetic properties.

This can be seen in particular from FIGS. 7 and 8. The alloys shown there have yield strengths of over 700 MPa combined with coercive forces of approximately 5.0 A/cm.

It can be seen in particular from FIG. 3 that if zirconium contents of less than 0.30% by weight are used, as disclosed by U.S. Pat. No. 3,634,072, it is not in fact possible to produce truly high-strength alloys.

By comparison with the composition 49.2 Co; 1.9 V; 0.16 Ta; 0.77 Zr; remainder Fe, the V content was varied from 0-3% and the Co content from 10-49% in batches 93/7179 to 93/7184. These exemplary embodiments are compiled in FIGS. 9 to 15 and Tables 26 to 32. Batch 74/5517 99/5278 is a comparison alloy from the prior art.

Table 26 shows the investigation into the appropriate quenching temperature for the special melt tests of batches 93/7179 to 93/7183. Only batch 93/7184 was cold-rolled without quenching. After quenching at the temperatures determined in each instance, cf. Table 26, it was possible for the strips to be cold-rolled to their final thickness.

FIGS. 9 to 11 show the relationship between induction and field strength for batches 93/7180 to 93/7184 after a final anneal under various annealing parameters. Inductances are corrected for air flow in accordance with ASTM A 341/A 341M and IEC 404-4. These results and the results of the tensile tests are listed in Tables 27, 29 and 31.

The relationship between Co content and V content and yield strength $R_{p0.2}$ is illustrated in graph form in FIGS. 12 and 13.

Tables 28, 30 and 32 show the resistivity and the hysteresis losses for batches 93/7179 to 93/7184. The relationship between resistivity $\rho_{e1}$ and Co and V content for various annealing parameters is presented in graph form in FIGS. 14 and 15.

The alloys according to the present invention are particularly suitable for magnetic bearings, in particular for the rotors of magnetic bearings, as described in U.S. Pat. No. 5,501,747, and as material for generators and for motors.

TABLE 1

| Strip 0.35 mm 1 h 720° C., H2, OK | | | | | | | | | | |
|---|---|---|---|---|---|---|---|---|---|---|
| | | | | | | Static magnetic measurements | | | | |
| | Wt. % | | | | | $H_c$ | | $B_8$ 1) | $B_{16}$ 1) | $B_{24}$ 1) |
| Batch | Co | V | Nb | Ni | Addition | [A/cm] | $B_3$ 1) [T] | [T] | [T] | [T] |
| 93/5973 | 49.10 | 1.95 | | 0.03 | Zr~0.28 | 10.945 | 0.088 | 0.368 | 1.669 | 1.893 |
| 93/5969 | 49.10 | 1.91 | 0.37 | 0.04 | | 10.638 | 0.087 | 0.394 | 1.861 | 1.985 |
| 93/5968 | 49.10 | 1.91 | 0.23 | 0.04 | | 12.144 | 0.077 | 0.287 | 1.650 | 1.918 |

TABLE 1-continued

| Strip 0.35 mm 1 h 720° C., H2, OK | | | | | | | | |
|---|---|---|---|---|---|---|---|---|
| | Without air flow correction from $B_{40}$ | | | Mechanical measurements | | | | |
| Batch | $B_{40}$[1)] [T] | $B_{80}$[1)] [T] | $B_{160}$[1)] [T] | $R_m$ [MPa] | $R_{p0.2}$ [MPa] | $A_L$ [%] | E-Modulus [GPa] | HV |
| 93/5973 | 2.018 | 2.135 | 2.222 | 1229 | 721 | 11.8-16.6 | 219-262 | 371-377 |
| 93/5969 | 2.080 | 2.180 | 2.270 | 1521 | 939 | 19.2-21.2 | 251-264 | 421-432 |
| 93/5968 | 2.038 | 2.152 | 2.246 | 1498 | 890 | 21.3-21.8 | 239-271 | 414-418 |

TABLE 2

| Anneal: 1 h, 720° C., H2, OK | | | | | | | | | | | | | | |
|---|---|---|---|---|---|---|---|---|---|---|---|---|---|---|
| | Wt. % | | | | Static magnetic measurements | | | | | Mechanical measurements | | | | |
| Batch | Co | V | Ni | Ad-dition | $H_c$ (A/cm) | $B_3$ (T) | $B_8$ (T) | $B_{16}$ (T) | $B_{24}$ (T) | $R_m$ (MPa) | $R_{p0.2}$ (MPa) | $A_L$ (%) | E-Modulus (GPa) | HV5 |
| 93/6279 | 49.20 | 1.89 | 0.06 | Zr~0.80 | 2.815 | 0.549 | 1.902 | 2.054 | 2.115 | 970 | 633 | 8.5 | 241 | 312 |
| 93/6284 | 49.35 | 1.90 | 0.43 | Zr~1.00 | 3.435 | 0.319 | 1.798 | 1.995 | 2.066 | 993 | 663 | 7.6-9.5 | 235 | 329 |
| 93/6285 | 49.35 | 1.89 | 0.44 | Zr~1.40 | 3.381 | 0.334 | 1.797 | 1.983 | 2.061 | 953 | 675 | 6.9-8.3 | 243 | 333 |

TABLE 3

| Anneal: 1 h/720° C./H2/OK/ With air flow correction from $B_{40}$ | | | | | | | | | | | | |
|---|---|---|---|---|---|---|---|---|---|---|---|---|
| | | | | | | Mechanical measurements | | | | | | |
| | Wt. % | | | | | $H_c$ | $B_3$[1)] | $B_8$[1)] | $B_{16}$[1)] | $B_{24}$[1)] | $B_{40}$[1)] | $B_{80}$[1)] | $B_{160}$[1)] |
| Batch | Co | V | Nb | Zr | Ta | (A/cm) | (T) | (T) | (T) | (T) | (T) | (T) | (T) |
| 93/6655 | 49.15 | 1.90 | 0.10 | # 0.86 | x | 5.265 | 0.204 | 1.393 | 1.850 | 1.965 | 2.050 | 2.130 | 2.170 |
| 93/6661 | 49.70 | 1.91 | x | # 0.77 | # 0.16 | 6.397 | 0.175 | 1.121 | 1.824 | 1.945 | 2.037 | 2.118 | 2.170 |

| | Mechanical measurements | | | | |
|---|---|---|---|---|---|
| Batch | $R_m$ (MPa) | $R_{p0.2}$ (MPa) | $A_L$ (%) | E-Modulus (GPa) | HV |
| 93/6655 | 1101-1251 | 753-772 | 9.7-13.9 | 239-248 | 326-332 |
| 93/6661 | 1245-1285 | 831-833 | 12.3-14.7 | 223-251 | 341-349 |

[1)]Induction B at a field H in A/cm, e.g. $B_{24}$ at H = 24 A/cm

TABLE 4

| Strip 0.35 mm 2 h 720° C., H2, OK | | | | | | | | | | |
|---|---|---|---|---|---|---|---|---|---|---|
| | | | | | | Static magnetic measurements | | | | |
| | Wt. % | | | | | $H_c$ | | $B_8$[1)] | $B_{16}$[1)] | $B_{24}$[1)] |
| Batch | Co | V | Nb | Ni | Addition | [A/cm] | $B_3$[1)] [T] | [T] | [T] | [T] |
| 93/5973 | 49.10 | 1.95 | | 0.03 | Zr~0.28 | 1.810 | 1.687 | 2.028 | 2.141 | 2.189 |
| 93/5969 | 49.10 | 1.91 | 0.37 | 0.04 | | 6.442 | 0.161 | 1.384 | 1.990 | 2.068 |
| 93/5968 | 49.10 | 1.91 | 0.23 | 0.04 | | 5.791 | 0.183 | 1.499 | 1.986 | 2.066 |

| | Without air flow correction from $B_{40}$ | | | Mechanical measurements | | | | |
|---|---|---|---|---|---|---|---|---|
| Batch | $B_{40}$[1)] [T] | $B_{80}$[1)] [T] | $B_{160}$[1)] [T] | $R_m$ [MPa] | $R_{p0.2}$ [MPa] | $A_L$ [%] | E-Modulus [GPa] | HV |
| 93/5973 | 2.236 | 2.303 | 2.378 | 907 | 504 | 9.5-9.6 | 246-263 | 247-261 |
| 93/5969 | 2.151 | 2.239 | 2.316 | 1379 | 761 | 15.1-22.5 | 257-268 | 332-335 |
| 93/5968 | 2.146 | 2.232 | 2.307 | 1335 | 700 | 16.6-23.0 | 243-250 | 323-326 |

TABLE 5

| Anneal: 2 h, 720° C., $H_2$, OK | | | | | | | | | | | | | | |
|---|---|---|---|---|---|---|---|---|---|---|---|---|---|---|
| | | | | | | | | | | Mechanical measurements | | | | |
| | Wt. % | | | | Static magnetic measurements | | | | | $R_m$ | $R_{p0.2}$ | $A_L$ | E-Modulus | |
| Batch | Co | V | Ni | Addition | $H_c$ (A/cm) | $B_3$ (T) | $B_8$ (T) | $B_{16}$ (T) | $B_{24}$ (T) | (MPa) | (MPa) | (%) | (GPa) | HV5 |
| 93/6279 | 49.20 | 1.89 | 0.06 | Zr~0.80 | 3.172 | 0.417 | 1.836 | 2.024 | 2.092 | 1041 | 612 | 9.7-11.0 | 242-243 | 283-293 |
| 93/6284 | 49.35 | 1.90 | 0.43 | Zr~1.00 | 2.950 | 0.588 | 1.843 | 2.010 | 2.084 | 965 | 636 | 5.1-11.3 | 245-247 | 291-294 |
| 93/6285 | 49.35 | 1.89 | 0.44 | Zr~1.40 | 3.287 | 0.412 | 1.847 | 1.969 | 2.048 | 1060 | 641 | 8.0-11.3 | 246-247 | 300-304 |

TABLE 6

| Anneal: 2 h/720° C./H2/OK/ | | | | | | With air flow correction from $B_{40}$ | | | | | | | |
|---|---|---|---|---|---|---|---|---|---|---|---|---|---|
| | | | | | | magnetic measurements | | | | | | | |
| | Wt. % | | | | | $H_c$ | $B_3$[1)] | $B_8$[1)] | $B_{16}$[1)] | $B_{24}$[1)] | $B_{40}$[1)] | $B_{80}$[1)] | $B_{160}$[1)] |
| Batch | Co | V | Nb | Zr | Ta | (A/cm) | (T) | (T) | (T) | (T) | (T) | (T) | (T) |
| 93/6655 | 49.15 | 1.90 | 0.10 | # 0.86 | x | 4.003 | 0.295 | 1.630 | 1.922 | 2.017 | 2.092 | 2.161 | 2.205 |
| 93/6661 | 49.70 | 1.91 | x | # 0.77 | # 0.16 | 5.218 | 0.218 | 1.429 | 1.887 | 1.991 | 2.068 | 2.145 | 2.196 |

| | Mechanical measurements | | | | |
|---|---|---|---|---|---|
| Batch | $R_m$ (MPa) | $R_{p0.2}$ (MPa) | $A_L$ (%) | E-Modulus (GPa) | HV |
| 93/6655 | 1095-1187 | 679-695 | 10.3-12.8 | 247-253 | 309-312 |
| 93/6661 | 1100-1267 | 749-766 | 9.3-13.9 | 235-249 | 323-329 |

[1)]Induction B at a field H in A/cm, z.B. $B_{24}$ at H = 24 A/cm

TABLE 7

| Anneal: 4 h, 720° C., H2, OK | | | | | | | | | | | |
|---|---|---|---|---|---|---|---|---|---|---|---|
| | | | | | magnetic measurements | | | | With air flow correction from $B_{40}$ | | |
| | Wt. % | | | | $H_c$ | $p_{hyst}/f$ | $p_{Fe}$[2)] f = 400 Hz | $p_{Fe}$[2)] f = 1000 Hz | $B_3$[1)] | $B_8$[1)] | $B_{16}$[1)] |
| Batch | Co | V | Ni | Addition | (A/cm) | (J/kg) | (W/kg) | (W/kg) | (T) | (T) | (T) |
| 93/6279 | 49.20 | 1.89 | 0.06 | Zr~0.80 | 1.600 | 0.1214 | 91.302 | 388.531 | 1.781 | 2.016 | 2.117 |
| 93/6284 | 49.35 | 1.90 | 0.43 | Zr~1.00 | 1.949 | 0.1502 | 100.746 | 404.399 | 1.629 | 1.958 | 2.075 |
| 93/6285 | 49.35 | 1.89 | 0.44 | Zr~1.40 | 2.005 | | | | 1.606 | 1.959 | 2.070 |

| | With air flow correction from $B_{40}$ | | | | Mechanical measurements | | | | |
|---|---|---|---|---|---|---|---|---|---|
| Batch | $B_{24}$[1)] (T) | $B_{40}$[1)] (T) | $B_{80}$[1)] (T) | $B_{160}$[1)] (T) | $R_m$ (MPa) | $R_{p0.2}$ (MPa) | $A_L$ (%) | E-Modulus (GPa) | HV5 |
| 93/6279 | 2.158 | 2.187 | 2.219 | 2.248 | 849 | 510 | 5.8-9.4 | 228-233 | 282-302 |
| 93/6284 | 2.127 | 2.163 | 2.198 | 2.227 | 940 | 558 | 7.1-9.2 | 236-254 | 319-321 |
| 93/6285 | 2.121 | | | | 913 | 570 | 6.8-8.2 | 230-238 | 336-338 |

$p_{hyst}/f$: static Hysteresis losses at B = 2 T
[1)]Induction B at a field H in A/cm, e.g. $B_{40}$ at H = 40 A/cm
[2)]$P_{Fe}$ at B = 2 T

TABLE 8

| Anneal: 4 h/720° C./H2/OK | | | | | | With air flow correction from $B_{40}$ | | | | | |
|---|---|---|---|---|---|---|---|---|---|---|---|
| | | | | | | magnetic measurements | | | | | |
| | Wt. % | | | | | $H_c$ | $p_{hyst}/f$ | $p_{Fe}$ 2) f = 400 Hz | $p_{Fe}$ 2) f = 1000 Hz | $B_3$ 1) | $B_8$ 1) |
| Batch | Co | V | Nb | Zr | Ta | (A/cm) | (J/kg) | (W/kg) | (W/kg) | (T) | (T) |
| 93/6655 | 49.15 | 1.90 | 0.10 | # 0.86 | x | 3.038 | 0.2482 | 139.757 | 501.111 | 0.602 | 1.738 |
| 93/6661 | 49.70 | 1.91 | x | # 0.77 | # 0.16 | 3.913 | 0.3098 | 164.061 | 560.637 | 0.320 | 1.680 |

| | | | | | | Mechanical measurements | | | | |
|---|---|---|---|---|---|---|---|---|---|---|
| | magnetic measurements | | | | | | | | E- | |
| Batch | $B_{16}$ 1) (T) | $B_{24}$ 1) (T) | $B_{40}$ 1) (T) | $B_{80}$ 1) (T) | $B_{160}$ 1) (T) | $R_m$ (MPa) | $R_{p0.2}$ (MPa) | $A_L$ (%) | Modulus (GPa) | HV |
| 93/6655 | 1.959 | 2.044 | 2.110 | 2.170 | 2.207 | 1107-1119 | 622-624 | 11.3-11.4 | 234-243 | 277-292 |
| 93/6661 | 1.952 | 2.035 | 2.035 | 2.165 | 2.206 | 1167-1241 | 692-700 | 11.7-13.9 | 240-250 | 310-329 |

$p_{hyst}/f$: static Hysteresis losses at B = 2 T

1)Induction B at a field H in A/cm, e.g. $B_{24}$ at H = 24 A/cm

2)$p_{Fe}$ at B = 2 T

TABLE 9

| Anneal: 1 h, 730° C., H2, OK | | | | | | | | | | | | | | |
|---|---|---|---|---|---|---|---|---|---|---|---|---|---|---|
| | Wt. % | | | | Static magnetic measurements | | | | | Mechanical measurements | | | | |
| Batch | Co | V | Ni | Ad-dition | $H_c$ (A/cm) | $B_3$ (T) | $B_8$ (T) | $B_{16}$ (T) | $B_{24}$ (T) | $R_m$ (MPa) | $R_{p0.2}$ (MPa) | $A_L$ (%) | E-Modulus (GPa) | HV5 |
| 93/6279 | 49.20 | 1.89 | 0.06 | Zr~0.80 | 1.966 | 1.687 | 1.999 | 2.104 | 2.155 | 938 | 583 | 8.4-8.6 | 243-244 | 280-281 |
| 93/6284 | 49.35 | 1.90 | 0.43 | Zr~1.00 | 2.514 | 0.929 | 1.921 | 2.056 | 2.114 | 997 | 611 | 9.1-9.3 | 243-249 | 300 |
| 93/6285 | 49.35 | 1.89 | 0.44 | Zr~1.40 | 2.431 | 1.125 | 1.913 | 2.045 | 2.103 | 964 | 629 | 6.5-9.4 | 237-250 | 301-303 |

TABLE 10

| Anneal: 2 h, 730° C., H2, OK | | | | | | | | | | | | | | |
|---|---|---|---|---|---|---|---|---|---|---|---|---|---|---|
| | Wt. % | | | | Static magnetic measurements | | | | | Mechanical measurements | | | | |
| Batch | Co | V | Ni | Ad-dition | $H_c$ (A/cm) | $B_3$ (T) | $B_8$ (T) | $B_{16}$ (T) | $B_{24}$ (T) | $R_m$ (MPa) | $R_{p0.2}$ (MPa) | $A_L$ (%) | E-Modulus (GPa) | HV5 |
| 93/6279 | 49.20 | 1.89 | 0.06 | Zr~0.80 | 1.717 | 1.758 | 2.017 | 2.118 | 2.169 | 875 | 513 | 7.3-9.0 | 238 | 270 |
| 93/6284 | 49.35 | 1.90 | 0.43 | Zr~1.00 | 2.115 | 1.515 | 1.962 | 2.083 | 2.133 | 884 | 547 | 6.0-8.9 | 236 | 285 |
| 93/6285 | 49.35 | 1.89 | 0.44 | Zr~1.40 | 2.334 | 1.271 | 1.921 | 2.045 | 2.097 | 738 | 561 | 2.9-7.3 | 242 | 297 |

TABLE 11

| Annneal: 1 h 740° C., H2, OK | | | | | | | | | | | | | | |
|---|---|---|---|---|---|---|---|---|---|---|---|---|---|---|
| | | | | | | | | | | Mechanical measurements | | | | |
| | Wt. % | | | | Static magnetic measurements | | | | | $R_m$ | $R_{p0.2}$ | $A_L$ | E-Modulus | |
| Batch | Co | V | Ni | Addition | $H_c$ (A/cm) | $B_3$ (T) | $B_8$ (T) | $B_{16}$ (T) | $B_{24}$ (T) | (MPa) | (MPa) | (%) | (GPa) | HV5 |
| 93/6279 | 49.20 | 1.89 | 0.06 | Zr~0.80 | 1.977 | 1.600 | 1.979 | 2.096 | 2.152 | 1051 | 561 | 10.2-12.1 | 230-241 | 305-314 |
| 93/6284 | 49.35 | 1.90 | 0.43 | Zr~1.00 | 2.282 | 1.289 | 1.931 | 2.066 | 2.121 | 1050 | 605 | 10.0-10.2 | 239-242 | 276-283 |
| 93/6285 | 49.35 | 1.89 | 0.44 | Zr~1.40 | 2.588 | 0.833 | 1.874 | 2.013 | 2.078 | 966 | 612 | 6.8-9.6 | 234-236 | 289-297 |

TABLE 12

Anneal: 1 h/740° C./H2/OK With air flow correction from $B_{40}$

| | Wt. % | | | | | Static magnetic measurements | | | | | | | |
|---|---|---|---|---|---|---|---|---|---|---|---|---|---|
| | | | | | | $H_c$ | $B_3$ 1) | $B_8$ 1) | $B_{16}$ 1) | $B_{24}$ 1) | $B_{40}$ 1) | $B_{80}$ 1) | $B_{160}$ 1) |
| Batch | Co | V | Nb | Zr | Ta | (A/cm) | (T) | (T) | (T) | (T) | (T) | (T) | (T) |
| 93/6655 | 49.15 | 1.90 | 0.10 | # 0.86 | x | 3.203 | 0.443 | 1.727 | 1.954 | 2.037 | 2.101 | 2.161 | 2.201 |
| 93/6661 | 49.70 | 1.91 | x | # 0.77 | # 0.16 | 3.901 | 0.297 | 1.699 | 1.958 | 2.040 | 2.105 | 2.170 | 2.217 |

| | Mechanical measurements | | | | |
|---|---|---|---|---|---|
| Batch | $R_m$ (MPa) | $R_{p0.2}$ (MPa) | $A_L$ (%) | E-Modulus (GPa) | HV |
| 93/6655 | 946-1100 | 638-650 | 7.4-11.1 | 240-241 | 294-297 |
| 93/6661 | 1169-1173 | 694-703 | 12.0-12.3 | 228-243 | 303-312 |

1)Induction B at a field H in A/cm, e.g. $B_{24}$ at H = 24 A/cm

TABLE 13

Annneal: 2 h 740° C., H2, OK

| | Wt. % | | | | Static magnetic measurements | | | | | Mechanical measurements | | | | |
|---|---|---|---|---|---|---|---|---|---|---|---|---|---|---|
| | | | | | | | | | | $R_m$ | $R_{p0.2}$ | $A_L$ | E-Modulus | |
| Batch | Co | V | Ni | Addition | $H_c$ (A/cm) | $B_3$ (T) | $B_8$ (T) | $B_{16}$ (T) | $B_{24}$ (T) | (MPa) | (MPa) | (%) | (GPa) | HV5 |
| 93/6279 | 49.20 | 1.89 | 0.06 | Zr~0.80 | 1.646 | 1.739 | 1.993 | 2.095 | 2.136 | 922 | 511 | 7.2-10.3 | 237-245 | 264-272 |
| 93/6284 | 49.35 | 1.90 | 0.43 | Zr~1.00 | 2.073 | 1.559 | 1.972 | 2.088 | 2.142 | 886 | 573 | 5.6-8.1 | 234-246 | 278-284 |
| 93/6285 | 49.35 | 1.89 | 0.44 | Zr~1.40 | 2.100 | 1.564 | 1.957 | 2.076 | 2.130 | 967 | 566 | 7.9-9.8 | 234-240 | 273-288 |

TABLE 14

Anneal: 2 h/740° C./H2/OK With air flow correction from $B_{40}$

| | Wt. % | | | | | Static magnetic measurements | | | | | | | |
|---|---|---|---|---|---|---|---|---|---|---|---|---|---|
| | | | | | | $H_c$ | $B_3$ 1) | $B_8$ 1) | $B_{16}$ 1) | $B_{24}$ 1) | $B_{40}$ 1) | $B_{80}$ 1) | $B_{160}$ 1) |
| Batch | Co | V | Nb | Zr | Ta | (A/cm) | (T) | (T) | (T) | (T) | (T) | (T) | (T) |
| 93/6655 | 49.15 | 1.90 | 0.10 | # 0.86 | x | 2.601 | 0.776 | 1.826 | 2.011 | 2.082 | 2.140 | 2.186 | 2.217 |
| 93/6661 | 49.70 | 1.91 | x | # 0.77 | # 0.16 | 2.773 | 0.636 | 1.838 | 2.012 | 2.085 | 2.137 | 2.189 | 2.220 |

| | Mechanical measurements | | | | |
|---|---|---|---|---|---|
| Batch | $R_m$ (MPa) | $R_{p0.2}$ (MPa) | $A_L$ (%) | E-Modulus (GPa) | HV |
| 93/6655 | 1037-1043 | 581-592 | 10.0-10.1 | 241-243 | 280-293 |
| 93/6661 | 1127-1143 | 627-635 | 11.6-12.5 | 223-246 | 289-295 |

1)Induction B at a field H in A/cm, z.B. $B_{24}$ at H = 24 A/cm

TABLE 15

Strip 0.35 mm 4 h 740° C., H2, OK

| | wt-. % | | | | | Static magnetic measurements | | | | | With air flow correction from $B_{40}$ | | |
|---|---|---|---|---|---|---|---|---|---|---|---|---|---|
| | | | | | | $H_c$ | $B_3$ 1) | $B_8$ 1) | $B_{16}$ 1) | $B_{24}$ 1) | $B_{40}$ 1) | $B_{80}$ 1) | $B_{160}$ 1) |
| Batch | Co | V | Nb | Ni | Addition | [A/cm] | [T] | [T] | [T] | [T] | [T] | [T] | [T] |
| 93/5973 | 49.10 | 1.95 | | 0.03 | Zr~0.28 | 1.149 | 1.931 | 2.101 | 2.185 | 2.219 | | | |
| 93/5969 | 49.10 | 1.91 | 0.37 | 0.04 | | 3.719 | 0.694 | 1.838 | 2.051 | 2.111 | 2.172 | 2.231 | 2.265 |
| 93/5968 | 49.10 | 1.91 | 0.23 | 0.04 | | 3.194 | 0.597 | 1.900 | 2.078 | 2.137 | 2.178 | 2.230 | 2.266 |

TABLE 15-continued

| Strip 0.35 mm 4 h 740° C., H2, OK | | | | | |
|---|---|---|---|---|---|
| | Mechanical measurements | | | | |
| Batch | $R_m$ [MPa] | $R_{p0.2}$ [MPa] | $A_L$ [%] | E-Modulus [GPa] | HV |
| 93/5973 | 813-874 | 407-438 | 8.4-9.7 | 241-250 | 231-236 |
| 93/5969 | 930-1261 | 582-617 | 8.9-17.5 | 229-252 | 275-291 |
| 93/5968 | 1061-1192 | 569-588 | 10.9-15.5 | 245-262 | 283-295 |

TABLE 16

| Anneal: 4 h, 740° C., H2, OK | | | | | | | | | | | |
|---|---|---|---|---|---|---|---|---|---|---|---|
| | | | | | Magnetic measurements | | | | With air flow correction | | |
| | | | | | | | $p_{Fe}$[2)] | $p_{Fe}$[2)] | from $B_{40}$ | | |
| | Wt. % | | | | $H_c$ | $p_{hyst}/f$ | f = 400 Hz | f = 1000 Hz | $B_3$[1)] | $B_8$[1)] | $B_{16}$[1)] |
| Batch | Co | V | Ni | Addition | (A/cm) | (J/kg) | (W/kg) | (W/kg) | (T) | (T) | (T) |
| 93/6279 | 49.20 | 1.89 | 0.06 | Zr~0.80 | 1.456 | 0.109 | 85.117 | 369.182 | 1.813 | 2.037 | 2.132 |
| 93/6284 | 49.35 | 1.90 | 0.43 | Zr~1.00 | 1.690 | | | | 1.727 | 2.001 | 2.104 |
| 93/6285 | 49.35 | 1.89 | 0.44 | Zr~1.40 | 1.974 | | | | 1.608 | 1.963 | 2.073 |

| | With air flow correction from $B_{40}$ | | | | Mechanical measurements | | | | | |
|---|---|---|---|---|---|---|---|---|---|---|
| Batch | $B_{24}$[1)] (T) | $B_{40}$[1)] (T) | $B_{80}$[1)] (T) | $B_{160}$[1)] (T) | $R_m$ (MPa) | $R_{p0.2}$ (MPa) | $A_L$ (%) | E-Modulus (GPa) | HV | $\rho_{el}$ ($\Omega mm^2/m$) |
| 93/6279 | 2.172 | 2.199 | 2.230 | 2.257 | 764 | 484 | 5.7-6.5 | 251 | 242 | 0.451 |
| 93/6284 | 2.152 | | | | 830 | 525 | 6.2-7.1 | 250 | 275 | 0.449 |
| 93/6285 | 2.121 | | | | 804 | 552 | 3.1-6.8 | 253 | 280 | 0.450 |

TABLE 17

| Anneal: 4 h/740° C./H2/OK/ With air flow correction from $B_{40}$ | | | | | | | | | | | | |
|---|---|---|---|---|---|---|---|---|---|---|---|---|
| | | | | | | magnetic measurements | | | | | | |
| | Wt. % | | | | | $H_c$ | $p_{hyst}/f$ | $p_{Fe}$[2)] f = 400 Hz | $p_{Fe}$[2)] f = 1000 Hz | $B_3$[1)] | $B_8$[1)] | $B_{16}$[1)] |
| Batch | Co | V | Nb | Zr | Ta | (A/cm) | (J/kg) | (W/kg) | (W/kg) | (T) | (T) | (T) |
| 93/6655 | 49.15 | 1.90 | 0.10 | # 0.86 | x | 2.270 | 0.1796 | 113.844 | 442.061 | 1.060 | 1.862 | 2.031 |
| 93/6661 | 49.70 | 1.91 | x | # 0.77 | # 0.16 | 2.351 | 0.1856 | 114.229 | 435.546 | 1.031 | 1.884 | 2.040 |

| | magnetic measurements | | | | Mechanical measurements | | | | |
|---|---|---|---|---|---|---|---|---|---|
| Batch | $B_{24}$[1)] (T) | $B_{40}$[1)] (T) | $B_{80}$[1)] (T) | $B_{160}$[1)] (T) | $R_m$ (MPa) | $R_{p0.2}$ (MPa) | $A_L$ (%) | E-Modulus (GPa) | HV |
| 93/6655 | 2.098 | 2.147 | 2.190 | 2.214 | 1034 | 538 | 9.7 | 255 | 268-271 |
| 93/6661 | 2.101 | 2.144 | 2.193 | 2.223 | 1058-1124 | 572-579 | 10.6-12.1 | 231-242 | 277-281 |

$p_{hyst}/f$: static Hysteresis losses at B = 2 T
1)Induction B at a field H in A/cm, z.B. $B_{24}$ at H = 24 A/cm
2)$p_{Fe}$ at B = 2 T

TABLE 18

| Anneal: 1 h, 750° C., H2, OK | | | | | | | | | | | | | | |
|---|---|---|---|---|---|---|---|---|---|---|---|---|---|---|
| | | | | | | | | | | Mechanical measurements | | | | |
| | wt-% | | | | Static magnetic measurements | | | | | | $R_{p0.2}$ | | E-Modulus | |
| Batch | Co | V | Ni | Addition | $H_c$ (A/cm) | $B_3$ (T) | $B_8$ (T) | $B_{16}$ (T) | $B_{24}$ (T) | $R_m$ (MPa) | (MPa) | $A_L$ (%) | (GPa) | HV5 |
| 93/6279 | 49.20 | 1.89 | 0.06 | Zr~0.80 | 1.595 | 1.783 | 2.033 | 2.136 | 2.179 | 919 | 533 | 7.4-9.5 | 218-250 | 272-285 |
| 93/6284 | 49.35 | 1.90 | 0.43 | Zr~1.00 | 1.804 | 1.667 | 1.965 | 2.076 | 2.123 | 832 | 547 | 3.9-8.1 | 198-223 | 285-288 |
| 93/6285 | 49.35 | 1.89 | 0.44 | Zr~1.40 | 1.983 | 1.543 | 1.921 | 2.046 | 2.101 | 948 | 572 | 7.9-8.4 | 238-256 | 290-297 |

TABLE 19

| Anneal: 1 h, 770° C., H2, OK | | | | | | | | | | | | | | |
|---|---|---|---|---|---|---|---|---|---|---|---|---|---|---|
| | Wt-% | | | | Static magnetic measurements | | | | | Mechanical measurements | | | | |
| Batch | Co | V | Ni | Addition | $H_c$ (A/cm) | $B_3$ (T) | $B_8$ (T) | $B_{16}$ (T) | $B_{24}$ (T) | $R_m$ (MPa) | $R_{p0.2}$ (MPa) | $A_L$ (%) | E-Modulus (GPa) | HV5 |
| 93/6279 | 49.20 | 1.89 | 0.06 | Zr~0.80 | 1.476 | 1.819 | 2.028 | 2.127 | 2.169 | 903 | 486 | 8.5-9.0 | 250-252 | 257-260 |
| 93/6284 | 49.35 | 1.90 | 0.43 | Zr~1.00 | 1.634 | 1.755 | 1.997 | 2.098 | 2.141 | 854 | 511 | 6.3-8.1 | 252-265 | 272-273 |
| 93/6285 | 49.35 | 1.89 | 0.44 | Zr~1.40 | 1.808 | 1.693 | 1.961 | 2.066 | 2.111 | 881 | 528 | 7.2-8.1 | 244-264 | 278-281 |

TABLE 20

| Anneal: 2 h, 770° C., H2, OK | | | | | | | | | | | | | | |
|---|---|---|---|---|---|---|---|---|---|---|---|---|---|---|
| | Wt-% | | | | Static magnetic measurements | | | | | Mechanical measurements | | | | |
| Batch | Co | V | Ni | Addition | $H_c$ (A/cm) | $B_3$ (T) | $B_8$ (T) | $B_{16}$ (T) | $B_{24}$ (T) | $R_m$ (MPa) | $R_{p0.2}$ (MPa) | $A_L$ (%) | E-Modulus (GPa) | HV5 |
| 93/6279 | 49.20 | 1.89 | 0.06 | Zr~0.80 | 1.207 | 1.860 | 2.035 | 2.121 | 2.155 | 851 | 421 | 8.2-9.5 | 236-244 | 254-262 |
| 93/6284 | 49.35 | 1.90 | 0.43 | Zr~1.00 | 1.427 | 1.813 | 2.014 | 2.106 | 2.141 | 882 | 451 | 8.5-9.1 | 239-244 | 262-268 |
| 93/6285 | 49.35 | 1.89 | 0.44 | Zr~1.40 | 1.571 | 1.761 | 1.977 | 2.073 | 2.110 | 861 | 486 | 6.8-7.9 | 231-249 | 270-277 |

TABLE 21

| Strip 0.35 mm 4 h 770° C., H2, OK | | | | | | | | | | |
|---|---|---|---|---|---|---|---|---|---|---|
| | Wt-% | | | | | static magnetic measurements | | | | |
| Batch | Co | V | Nb | Ni | Addition | $H_c$ [A/cm] | $B_3$ 1) [T] | $B_8$ 1) [T] | $B_{16}$ 1) [T] | $B_{24}$ 1) [T] |
| 93/5973 | 49.10 | 1.95 | | 0.03 | Zr~0.28 | 0.885 | 1.980 | 2.218 | 2.200 | 2.227 |
| 93/5969 | 49.10 | 1.91 | 0.37 | 0.04 | | 2.038 | 1.582 | 2.026 | 2.128 | 2.174 |
| 93/5968 | 49.10 | 1.91 | 0.23 | 0.04 | | 1.700 | 1.755 | 2.061 | 2.154 | 2.192 |

| | with air flow correction from $B_{40}$ | | | mechanical measurements | | | | |
|---|---|---|---|---|---|---|---|---|
| Batch | $B_{40}$ 1) [T] | $B_{80}$ 1) [T] | $B_{160}$ 1) [T] | $R_m$ [MPa] | $R_{p0.2}$ [MPa] | $A_L$ [%] | E-Modulus [GPa] | HV |
| 93/5973 | | | | 492-815 | 370-389 | 3.6-9.5 | 232-248 | 206-210 |
| 93/5969 | 2.211 | 2.248 | 2.275 | 1018-1129 | 493-501 | 11.1-13.9 | 246-250 | 232-236 |
| 93/5968 | 2.222 | 2.252 | 2.275 | 942-1087 | 471-479 | 9.8-13.5 | 239-253 | 226-227 |

TABLE 22

| Anneal: 4 h, 770° C., H2, OK | | | | | | | | |
|---|---|---|---|---|---|---|---|---|
| | Wt-% | | | | Magnetic measurements | | | |
| Batch | Co | V | Ni | Addition | $H_c$ (A/cm) | $p_{hyst}$/f (J/kg) | $p_{Fe}$ 2) f = 400 Hz (W/kg) | $p_{Fe}$ 2) f = 1000 Hz (W/kg) |
| 93/6279 | 49.20 | 1.89 | 0.06 | Zr~0.80 | 1.234 | 0.0819 | 77.873 | 363.928 |
| 93/6284 | 49.35 | 1.90 | 0.43 | Zr~1.00 | 1.489 | 0.1241 | 99.401 | 442.150 |

| | with air flow correction from $B_{40}$ | | | | | | | Mechanical measurements | | | | |
|---|---|---|---|---|---|---|---|---|---|---|---|---|
| Batch | $B_3$ 1) (T) | $B_8$ 1) (T) | $B_{16}$ 1) (T) | $B_{24}$ 1) (T) | $B_{40}$ 1) (T) | $B_{80}$ 1) (T) | $B_{160}$ 1) (T) | $R_m$ (MPa) | $R_{p0.2}$ (MPa) | $A_L$ (%) | E-Modulus (GPa) | HV |
| 93/6279 | 1.861 | 2.062 | 2.149 | 2.184 | 2.207 | 2.235 | 2.260 | 766 | 444 | 4.3-7.5 | 239 | 250 |
| 93/6284 | 1.608 | 1.867 | 1.968 | 2.010 | 2.038 | 2.066 | 2.090 | 782 | 491 | 4.3-8.0 | 233 | 261 |

TABLE 23

| Anneal: 4 h/770° C./H2/OK with air flow correction from $B_{40}$ | | | | | | | | | |
|---|---|---|---|---|---|---|---|---|---|
| | Wt-% | | | | | Magnetic measurements | | | |
| Batch | Co | V | Nb | Zr | Ta | $H_c$ (A/cm) | $p_{hyst}$/f (J/kg) | $p_{Fe}$ 2) f = 400 Hz (W/kg) | $p_{Fe}$ 2) f = 1000 Hz (W/kg) |
| 93/6655 | 49.15 | 1.90 | 0.10 | # 0.86 | x | 1.819 | 0.1445 | 99.664 | 418.788 |
| 93/6661 | 49.70 | 1.91 | x | # 0.77 | # 0.16 | 1.586 | 0.1263 | 89.614 | 381.568 |

| | Magnetic measurements | | | | | | | Mechanical measurements | | | | |
|---|---|---|---|---|---|---|---|---|---|---|---|---|
| Batch | $B_3$ 1) (T) | $B_8$ 1) (T) | $B_{16}$ 1) (T) | $B_{24}$ 1) (T) | $B_{40}$ 1) (T) | $B_{80}$ 1) (T) | $B_{160}$ 1) (T) | $R_m$ (MPa) | $R_{p0.2}$ (MPa) | $A_L$ (%) | E-Modulus (GPa) | HV |
| 93/6655 | 1.457 | 1.928 | 2.067 | 2.127 | 2.157 | 2.194 | 2.227 | 856-931 | 481-484 | 7.2-8.5 | 237-241 | 249-264 |
| 93/6661 | 1.623 | 1.963 | 2.085 | 2.139 | 2.168 | 2.208 | 2.227 | 940-974 | 478-485 | 9.0-9.8 | 217-225 | 241-258 |

$p_{hyst}$/f: static hysteresis losses B = 2 T
1) Induction B at a field H in A/cm, e.g. $B_{24}$ at H = 24 A/cm
2) $P_{Fe}$ at B = 2 T

TABLE 24

| Strip 0.35 mm 4 h 800° C., H2, OK | | | | | | | | | | |
|---|---|---|---|---|---|---|---|---|---|---|
| | | | | | | static magnetic measurements | | | | |
| | Wt-% | | | | | | $B_3$ 1) | $B_8$ 1) | $B_{16}$ 1) | |
| Batch | Co | V | Nb | Ni | Addition | $H_c$ [A/cm] | [T] | [T] | [T] | $B_{24}$ 1) [T] |
| 93/5973 | 49.10 | 1.95 | | 0.03 | Zr~0.28 | 0.750 | 2.004 | 2.141 | 2.208 | 2.237 |
| 93/5969 | 49.10 | 1.91 | 0.37 | 0.04 | | 1.548 | 1.842 | 2.080 | 2.157 | 2.200 |
| 93/5968 | 49.10 | 1.91 | 0.23 | 0.04 | | 1.360 | 1.902 | 2.098 | 2.180 | 2.216 |

| | with air flow correction from $B_{40}$ | | | mechanical measurements | | | | |
|---|---|---|---|---|---|---|---|---|
| Batch | $B_{40}$ 1) [T] | $B_{80}$ 1) [T] | $B_{160}$ 1) [T] | $R_m$ [MPa] | $R_{p0.2}$ [MPa] | $A_L$/% | E-Modulus [GPa] | HV |
| 93/5973 | | | | 534-806 | 365-384 | 3.7-8.3 | 233-246 | 219-228 |
| 93/5969 | 2.226 | 2.259 | 2.285 | 827-1060 | 446-474 | 7.2-12.7 | 235-253 | 250-258 |
| 93/5968 | 2.235 | 2.263 | 2.284 | 926-1015 | 435-444 | 10.2-12.7 | 245-255 | 230-234 |

TABLE 25

Anneal: 4 h, 800° C., H2, OK

| | Wt-% | | | | Magnetic measurements | | | | with air flow correction from $B_{40}$ | |
|---|---|---|---|---|---|---|---|---|---|---|
| Batch | Co | V | Ni | Addition | $H_c$ (A/cm) | $p_{hyst}/f$ (J/kg) | $p_{Fe}$ 2) f = 400 Hz (W/kg) | $p_{Fe}$ 2) f = 1000 Hz (W/kg) | $B_3$ 1) (T) | $B_8$ 1) (T) |
| 93/6279 | 49.20 | 1.89 | 0.06 | Zr ~ 0.80 | 1.062 | 0.0744 | 74.154 | 351.926 | 1.913 | 2.080 |
| 93/6284 | 49.35 | 1.90 | 0.43 | Zr ~ 1.00 | 1.264 | 0.0945 | 87.404 | 404.535 | 1.835 | 2.039 |
| 93/6285 | 49.35 | 1.89 | 0.44 | Zr ~ 1.40 | 1.456 | | | | 1.813 | 2.015 |

| | with air flow correction from $B_{40}$ | | | | | Mechanical measurements | | | | | |
|---|---|---|---|---|---|---|---|---|---|---|---|
| Batch | $B_{16}$ 1) (T) | $B_{24}$ 1) (T) | $B_{40}$ 1) (T) | $B_{80}$ 1) (T) | $B_{160}$ 1) (T) | $R_m$ (MPa) | $R_{p0.2}$ (MPa) | $A_L$ (%) | E-Modulus (GPa) | HV | □$_{el}$ (□mm$^2$/m) |
| 93/6279 | 2.158 | 2.188 | 2.209 | 2.237 | 2.261 | 798 | 420 | 6.7-8.1 | 233 | 250 | 0.447 |
| 93/6284 | 2.129 | 2.164 | 2.185 | 2.210 | 2.234 | 843 | 465 | 6.6-7.7 | 240 | 261 | 0.448 |
| 93/6285 | 2.104 | 2.140 | | | | 808 | 504 | 4.8-7.2 | 243 | 279 | 0.454 |

TABLE 26

Anneal: 4 h/800° C./H2/OK/ with air flow correction from $B_{40}$

| | Wt-% | | | | | Magnetic measurements | | | | | |
|---|---|---|---|---|---|---|---|---|---|---|---|
| Batch | Co | V | Nb | Zr | Ta | $H_c$ (A/cm) | $p_{hyst}/f$ (J/kg) | $p_{Fe}$ 2) f = 400 Hz (W/kg) | $p_{Fe}$ 2) f = 1000 Hz (W/kg) | $B_3$ 1) (T) | $B_8$ 1) (T) |
| 93/6655 | 49.15 | 1.90 | 0.10 | #0.86 | x | 1.640 | 0.1279 | 98.076 | 421.081 | 1.623 | 1.959 |
| 93/6661 | 49.70 | 1.91 | x | #0.77 | #0.16 | 1.380 | 0.1042 | 83.840 | 367.657 | 1.684 | 1.983 |

| | Magnetic measurements | | | | | Mechanical measurements | | | | |
|---|---|---|---|---|---|---|---|---|---|---|
| Batch | $B_{16}$ 1) (T) | $B_{24}$ 1) (T) | $B_{40}$ 1) (T) | $B_{80}$ 1) (T) | $B_{160}$ 1) (T) | $R_m$ (MPa) | $R_{p0.2}$ (MPa) | $A_L$ (%) | E-Modulus (GPa) | HV |
| 93/6655 | 2.084 | 2.137 | 2.167 | 2.204 | 2.232 | 848-869 | 460-462 | 7.0-7.5 | 240-247 | 249-260 |
| 93/6661 | 2.099 | 2.153 | 2.177 | 2.208 | 2.229 | 910-936 | 441-447 | 8.7-9.1 | 241-249 | 244-254 |

$p_{hyst}/f$: static hysteresis losses at B = 2 T
1) Induction B at a field H in A/cm, e.g. $B_{24}$ at H = 24 A/cm
2) $p_{Fe}$ at B = 2 T

TABLE 27

| Quenching experiments: | Microstructural state | | | | | Choice of Quenching |
|---|---|---|---|---|---|---|
| Batch | 3 h/880° C. | 3 h/900° C. | 3 h/920° C. | 3 h/940° C. | 3 h/950° C. | conditions |
| 93/7179 49.2 Co/0 V/ 0.16 Ta/0.77 Zr | α | α | α | α + a little α' | α + a little α' | 2 h/970° C./air |
| 93/7180 49.2 Co/3 V / 0.16 Ta/0.77 Zr | α + α' | α + α' | α + α' | α' | α' | 2 h/900° C./air |
| 93/7181 49.2 Co/1 V/ 0.16 Ta/0.77 Zr | α | α | α | α + a little α' | α + α' at edge more α' | 2 h/970° C./air |
| 93/7182 35 Co/2 V/ 0.16 Ta/0.77 Zr | α | α | α + a little α' | α + a little α' | α + a little α' | 2 h/800° C./air |
| 93/7183 27 Co/2 V/ 0.16 Ta/0.77 Zr | α | α | α | α | α + a little α' | 2 h/800° C./air |

TABLE 28

Anneal: 1 h/720° C./H2/OK/

| Batch | Wt. % Co | V | Ta | Zr | Density (g/cm³) | Magnetic measurements; with air flow correction from $B_{40}$ $H_c$ (A/cm) | $B_3$ 1) (T) | $B_8$ 1) (T) | $B_{16}$ 1) (T) | $B_{24}$ 1) (T) | $B_{40}$ 1) (T) | $B_{80}$ 1) (T) | $B_{160}$ 1) (T) |
|---|---|---|---|---|---|---|---|---|---|---|---|---|---|
| 93/7180 | 49.2 | 3 | 0.16 | 0.77 | 8.12 | 12.761 | 0.093 | 0.319 | 1.229 | 1.666 | 1.843 | 1.971 | 2.047 |
| 93/7181 | 49.2 | 1 | 0.16 | 0.77 | 8.12 | 5.842 | 0.160 | 1.435 | 1.954 | 2.048 | 2.126 | 2.205 | 2.258 |
| 93/7182 | 35 | 2 | 0.16 | 0.77 | 8.004 | 9.285 | 0.120 | 0.643 | 1.811 | 1.931 | 2.033 | 2.137 | 2.211 |
| 93/7183 | 27 | 2 | 0.16 | 0.77 | 7.990 | 9.248 | 0.077 | 0.589 | 1.661 | 1.785 | 1.892 | 2.039 | 2.171 |
| 93/7184 | 10 | 2 | 0.16 | 0.77 | 7.872 | 6.228 | 0.103 | 1.105 | 1.484 | 1.603 | 1.708 | 1.842 | 1.985 |
| 74/5517 | 49.3 | 2 | 0.18 | 0.75 | 8.12 | 5.905 | 0.184 | 1.189 | 1.812 | 1.940 | 2.033 | 2.114 | 2.158 |
| 99/5278 | | | | | | | | | | | | | |

| Batch | Mechanical measurements $R_m$ (MPa) | $R_{p0.2}$ (MPa) | $A_L$ (%) | E-Modulus (GPa) | HV |
|---|---|---|---|---|---|
| 93/7180 | 1328-1389 | 998-1018 | 10.1-11.9 | 255-263 | 394-412 |
| 93/7181 | 955-1145 | 819-897 | 5.1-11.2 | 240-261 | 364-371 |
| 93/7182 | 1301-1323 | 994-1016 | 11.1-12.1 | 254-267 | 375-390 |
| 93/7183 | 898-930 | 791-826 | 6.9-9.4 | 234-247 | 281-293 |
| 93/7184 | 580-597 | 492-500 | 16.4-17.4 | 208-221 | 180-188 |
| 74/5517 | 1203-1286 | 779-819 | 10.5-14.3 | 247-265 | 333-356 |
| 99/5278 | | | | | |

1)Induction B at a field H in A/cm, e.g. $B_3$ at H = 3 A/cm

TABLE 29

| Batch | $\rho_{el}$ 3) (μΩm) | $p_{1\ T}^{50\ Hz}$ (W/kg) | $p_{1.5\ T}^{50\ Hz}$ (W/kg) | $p_{2\ T}^{50\ Hz}$ (W/kg) | $p_{1\ T}^{400\ Hz}$ (W/kg) | $p_{1.5\ T}^{400\ Hz}$ (W/kg) | $p_{2\ T}^{400\ Hz}$ (W/kg) | $p_{1\ T}^{1000\ Hz}$ (W/kg) | $p_{1.5\ T}^{1000\ Hz}$ (W/kg) | $p_{2\ T}^{1000\ Hz}$ (W/kg) |
|---|---|---|---|---|---|---|---|---|---|---|
| 93/7180 | 0.733 | 11.83 | 24.51 | 48.73 2) | 99.78 | 247.8 | 425.0 | 279.9 | 683.4 | 1166 |
| 93/7181 | 0.365 | 6.372 | 14.35 | 25.76 | 64.20 | 141.5 | 246.5 | 203.8 | 468.3 | 834.5 |
| 93/7182 | 0.477 | 12.31 | 24.09 | 37.09 2) | 106.7 | 248.3 | 343.9 | 295.4 | 613.2 | 1040 |
| 93/7183 | 0.457 | 13.42 | 26.25 | 42.26 2) | 124.3 | 222.6 | 383.6 | 335.2 | 723.3 | 1162 |
| 93/7184 | 0.437 | 11.47 | 21.19 2) | 33.87 2) | 102.6 | 205.2 | 326.3 2) | 301.3 | 632.7 | 984.3 2) |
| 74/5517 | — | 5.8 | 14.02 | 25.2 | 53.9 | 118.2 | 234.2 | 168.7 | 401.3 | 728.8 |
| 99/5278 | | | | | | | | | | |

2)Form factor FF = 1.111 ± 1% not fulfilled

3)$\rho_{el}$ calculated from the gradient m of the line in p/f (f)-Diagram at B = 2 T with m~1/$\rho_{el}$ and $\rho_{el}$(Vacoflux 50) = 0.44 μΩm $p_{1\ T}^{50\ Hz}$ = hysteresis losses at an Induction B = 1 T and a Frequency f = 50 Hz

TABLE 30

Anneal: 2 h/750° C./H2/OK/

| Batch | Wt. % Co | V | Ta | Zr | density (g/cm³) | Magnetic measurements; with air flow correction from $B_{40}$ $H_c$ (A/cm) | $B_3$ 1) (T) | $B_8$ 1) (T) | $B_{16}$ 1) (T) | $B_{24}$ 1) (T) | $B_{40}$ 1) (T) | $B_{80}$ 1) (T) | $B_{160}$ 1) (T) |
|---|---|---|---|---|---|---|---|---|---|---|---|---|---|
| 93/7180 | 49.2 | 3.0 | 0.16 | 0.77 | 8.12 | 6.396 | 0.188 | 0.823 | 1.546 | 1.754 | 1.911 | 2.043 | 2.144 |
| 93/7181 | 49.2 | 1.0 | 0.16 | 0.77 | 8.12 | 2.660 | 0.701 | 1.872 | 2.053 | 2.125 | 2.185 | 2.240 | 2.276 |
| 93/7182 | 35 | 2 | 0.16 | 0.77 | 8.004 | 6.459 | 0.118 | 1.090 | 1.833 | 1.950 | 2.055 | 2.159 | 2.222 |
| 93/7183 | 27 | 2 | 0.16 | 0.77 | 7.990 | 7.507 | 0.079 | 0.803 | 1.654 | 1.765 | 1.869 | 2.020 | 2.168 |
| 93/7184 | 10 | 2 | 0.16 | 0.77 | 7.872 | 4.728 | 0.162 | 1.222 | 1.498 | 1.599 | 1.691 | 1.816 | 1.964 |
| 74/5517 | 49.3 | 2 | 0.18 | 0.75 | 8.12 | 2.248 | 0.970 | 1.830 | 2.011 | 2.081 | 2.134 | 2.179 | 2.206 |
| 99/5278 | | | | | | | | | | | | | |

| Batch | Mechanical measurements $R_m$ (MPa) | $R_{p0.2}$ (MPa) | $A_L$ (%) | E-Modulus (GPa) | HV |
|---|---|---|---|---|---|
| 93/7180 | 961-1231 | 678-728 | 6.6-12.1 | 250-260 | 316-344 |
| 93/7181 | 930-946 | 602-611 | 7.7-8.2 | 248-259 | 292-303 |
| 93/7182 | 985-1266 | 790-802 | 5.4-13.7 | 258-263 | 323-339 |
| 93/7183 | 832-847 | 625-637 | 8.9-11.9 | 237-246 | 258-264 |

TABLE 30-continued

| Anneal: 2 h/750° C./H2/OK/ | | | | | |
|---|---|---|---|---|---|
| 93/7184 | 515-527 | 315-327 | 20.0-22.9 | 206-213 | 142-145 |
| 74/5517 | 941-1179 | 551-563 | 8.4-14.7 | 216-239 | 274-291 |
| 99/5278 | | | | | |

[1)]Induction B at a field H in A/cm, e.g. $B_3$ at H = 3 A/cm

TABLE 31

| Batch | $\rho_{el}$[3)] (μΩm) | $p_{1\ T}^{50\ Hz}$ (W/kg) | $p_{1.5\ T}^{50\ Hz}$ (W/kg) | $p_{2\ T}^{50\ Hz}$ (W/kg) | $p_{1\ T}^{400\ Hz}$ (W/kg) | $p_{1.5\ T}^{400\ Hz}$ (W/kg) | $p_{2\ T}^{400\ Hz}$ (W/kg) | $p_{1\ T}^{1000\ Hz}$ (W/kg) | $p_{1.5\ T}^{1000\ Hz}$ (W/kg) | $p_{2\ T}^{1000\ Hz}$ (W/kg) |
|---|---|---|---|---|---|---|---|---|---|---|
| 93/7180 | 0.720 | 5.560 | 13.91 | 22.92[2)] | 49.35 | 126.7 | 208.0 | 152.3 | 385.1 | 628.1 |
| 93/7181 | 0.350 | 2.955 | 6.606 | 11.24 | 35.62 | 77.80[2)] | 143.9 | 132.2 | 305.0 | 586.3 |
| 93/7182 | 0.493 | 7.965 | 17.15 | 25.97[2)] | 73.44 | 155.7[2)] | 248.7 | 213.8 | 462.5 | 804.2 |
| 93/7183 | 0.468 | 11.42 | 21.51 | 34.37[2)] | 99.72 | 200.1 | 318.0 | 288.7 | 613.8 | 980.3 |
| 93/7184 | 0.428 | 8.934 | 17.60 | 26.20[2)] | 82.67 | 160.9 | 261.1[2)] | 261.2 | 547.6 | 865.2[2)] |
| 74/5517 | — | 2.4 | 5.59 | 9.9 | 27.1 | 56.25 | 109.1 | 98.0 | 230.5 | 413.0 |
| 99/5278 | | | | | | | | | | |

[2)]Form factor FF = 1.111 ± 1% not fulfilled
[3)]$\rho_{el}$ calculated from the gradient m of the line p/f (f)-Diagram at B = 2 T with m ~$1/\rho_{el}$ and $\rho_{el}$(Vacoflux 50) = 0.44 μΩm $\rho_{1\ T}^{50\ Hz}$ = hysteresis losses at an Induction B = 1 T and a Frequency f = 50 Hz

TABLE 32

| Anneal: 4 h/840° C./H2/OK/ | | | | | | | | | | | | | |
|---|---|---|---|---|---|---|---|---|---|---|---|---|---|
| | | | | | | Magnetic measurements; with air flow correction from $B_{40}$ | | | | | | | |
| | Wt-% | | | | density | $H_c$ | $B_3$[1)] | $B_8$[1)] | $B_{16}$[1)] | $B_{24}$[1)] | $B_{40}$[1)] | $B_{80}$[1)] | $B_{160}$[1)] |
| Batch | Co | V | Ta | Zr | (g/cm³) | (A/cm) | (T) | (T) | (T) | (T) | (T) | (T) | (T) |
| 93/7180 | 49.2 | 3.0 | 0.16 | 0.77 | 8.12 | 6.398 | 0.150 | 0.512 | 1.099 | 1.384 | 1.652 | 1.907 | 2.037 |
| 93/7181 | 49.2 | 1.0 | 0.16 | 0.77 | 8.12 | 1.396 | 1.614 | 1.958 | 2.104 | 2.165 | 2.213 | 2.254 | 2.282 |
| 93/7182 | 35 | 2 | 0.16 | 0.77 | 8.004 | 2.355 | 0.372 | 1.556 | 1.818 | 1.953 | 2.092 | 2.199 | 2.240 |
| 93/7183 | 27 | 2 | 0.16 | 0.77 | 7.990 | 3.357 | 0.154 | 1.399 | 1.620 | 1.717 | 1.820 | 1.974 | 2.141 |
| 93/7184 | 10 | 2 | 0.16 | 0.77 | 7.872 | 3.187 | 0.386 | 1.249 | 1.482 | 1.576 | 1.663 | 1.792 | 1.944 |
| 74/5517 | 49.3 | 2 | 0.18 | 0.75 | 8.12 | 1.065 | 1.618 | 1.942 | 2.074 | 2.131 | 2.165 | 2.196 | 2.216 |
| 99/5278 | | | | | | | | | | | | | |

| | Mechanical measurements | | | | |
|---|---|---|---|---|---|
| Batch | $R_m$ (MPa) | $R_{p0.2}$ (MPa) | $A_L$ (%) | E-Modulus (GPa) | HV |
| 93/7180 | 995-1199 | 553-600 | 8.3-12.2 | 250-258 | 287-302 |
| 93/7181 | 662-736 | 379-387 | 5.3-6.2 | 257-259 | 220-233 |
| 93/7182 | 811-945 | 478-490 | 5.8-7.9 | 253-261 | 240-254 |
| 93/7183 | 701-730 | 379-390 | 10.8-12.7 | 236-246 | 202-217 |
| 93/7184 | 439-451 | 190-195 | 23.8-26.5 | 198-211 | 116-121 |
| 74/5517 | 841-1013 | 410-427 | 7.6-10.9 | 236-271 | 235-248 |
| 99/5278 | | | | | |

[1)]Induction B at a field H in A/cm, e.g. $B_3$ at H = 3 A/cm

TABLE 33

| Batch | $\rho_{el}$[3)] (μΩm) | $p_{1\ T}^{50\ Hz}$ (W/kg) | $p_{1.5\ T}^{50\ Hz}$ (W/kg) | $p_{2\ T}^{50\ Hz}$ (W/kg) | $p_{1\ T}^{400\ Hz}$ (W/kg) | $p_{1.5\ T}^{400\ Hz}$ (W/kg) | $p_{2\ T}^{400\ Hz}$ (W/kg) | $p_{1\ T}^{1000\ Hz}$ (W/kg) | $p_{1.5\ T}^{1000\ Hz}$ (W/kg) | $p_{2\ T}^{1000\ Hz}$ (W/kg) |
|---|---|---|---|---|---|---|---|---|---|---|
| 93/7180 | 0.649 | 5.847 | 13.67 | 18.82[2)] | 53.17 | 121.7 | 179.0[2)] | 163.3 | 385.2 | 559.8 |
| 93/7181 | 0.316 | 1.829 | 3.883 | 6.266 | 26.64 | 61.00 | 104.5 | 108.6 | 272.9 | 510.6 |
| 93/7182 | 0.446 | 3.770 | 6.844 | 8.882[2)] | 40.08 | 68.84 | 118.0 | 139.1 | 263.8 | 464.9 |
| 93/7183 | 0.408 | 5.736 | 11.32 | 16.59[2)] | 56.00 | 119.3 | 175.4 | 182.5 | 409.4 | 635.5 |
| 93/7184 | 0.370 | 6.314 | 12.96[2)] | 19.54[2)] | 63.53 | 124.4 | 204.3[2)] | 205.4 | 486.0 | 707.4[2)] |
| 74/5517 | — | 1.7 | 3.348 | 5.4 | 21.6 | 46.85 | 78.5 | 82.4 | 183.8 | 352.5 |
| 99/5278 | | | | | | | | | | |

[2)]factor FF = 1.111 ± 1% not fulfilled
[3)]ρel calculated from the gradient m of the straight line in p/f (f)-Diagram at B = 2 T with m ~$1/\rho_{el}$ and $\rho_{el}$(Vacoflux 50) = 0.44 μΩm $\rho_{1\ T}^{50\ Hz}$ = hysteresis losses at an induction B = 1 T and a Frequency f = 50 Hz

We claim:

1. A high-strength, soft-magnetic iron-cobalt-vanadium alloy, consisting of:

$35 \leqq Co \leqq 55\%$ by weight, $0.75 \leqq V \leqq 2.5\%$ by weight, $0 \leqq (Ta+2\times Nb) \leqq 1\%$ by weight, $0.5 < Zr \leqq 1\%$ by weight, $Ni \leqq 5\%$ by weight, remainder Fe and melting-related and/or incidental impurities.

2. The high-strength, soft-magnetic iron-cobalt-vanadium alloy as claimed in claim 1, wherein the zirconium content is $0.6 \leqq Zr \leqq 0.8\%$ by weight.

3. The high-strength, soft-magnetic iron-cobalt-vanadium alloy as claimed in claim 1, in the form of a magnetic bearing.

4. The high-strength, soft-magnetic iron-cobalt-vanadium alloy as claimed in claim 1, in the form of a rotor.

5. A high strength, soft-magnetic iron-cobalt-vanadium alloy, consisting of:

$45 \leqq Co \leqq 50\%$ by weight, $1 \leqq V \leqq 2\%$ by weight, $0.04 \leqq (Ta+2\times Nb) \leqq 0.8\%$ by weight, $0.5 \leqq Zr \leqq 1\%$ by weight, $Ni \leqq 1\%$ by weight, remainder Fe and melting-related and/or incidental impurities.

6. The high strength, soft-magnetic iron-cobalt-vanadium alloy of claim 5, wherein the content of melting-related and/or incidental metallic impurities is:

$Cu \leqq 0.2$, $Cr \leqq 0.3$, $Mo \leqq 0.3$, $Si \leqq 0.5$, $Mu \leqq 0.3$, and $Al \leqq 0.3$.

7. A high strength, soft-magnetic iron-cobalt-vanadium alloy, consisting of:

$48 \leqq Co \leqq 50\%$ by weight, $1.5 \leqq V \leqq 2\%$ by weight, $0.04 \leqq (Ta+2\times Nb) \leqq 0.5\%$ by weight, $0.6 \leqq Zr \leqq 0.8\%$ by weight, $Ni \leqq 0.5\%$ by weight, remainder Fe and melting-related and/or incidental impurities.

8. The high strength, soft-magnetic iron-cobalt-vanadium alloy of claim 7, wherein the content of melting-related and/or incidental metallic impurities is:

$Cu \leqq 0.1$, $Cr \leqq 0.2$, $Mo \leqq 0.2$, $Si \leqq 0.2$, $Mu \leqq 0.2$ and $Al \leqq 0.2$.

9. The high-strength, soft-magnetic iron-cobalt-vanadium alloy as claimed in claim 1, wherein the cobalt content is between $45 \leqq Co \leqq 50\%$ by weight.

10. The high-strength, soft-magnetic iron-cobalt-vanadium alloy as claimed in claim 1, wherein the cobalt content is between $48 \leqq Co \leqq 50\%$ by weight.

11. The high-strength, soft-magnetic iron-cobalt-vanadium alloy as claimed in claim 1, wherein the vanadium content is between $1 \leqq V \leqq 2\%$ by weight.

12. The high-strength, soft-magnetic iron-cobalt-vanadium alloy as claimed in claim 1, wherein the vanadium content is between $1.5 \leqq V \leqq 2\%$ by weight.

13. The high-strength, soft-magnetic iron-cobalt-vanadium alloy as claimed in claim 1, wherein the niobium and/or tantalum content is between $0.04 \leqq (Ta+2\times Nb) \leqq 0.8\%$ by weight.

14. The high-strength, soft-magnetic iron-cobalt-vanadium alloy as claimed in claim 1, wherein the niobium and/or tantalum content is between $0.04 \leqq (Ta+2\times Nb) \leqq 0.5\%$ by weight.

15. The high-strength, soft-magnetic iron-cobalt-vanadium alloy as claimed in claim 1, in which the niobium and/or tantalum content is between $0.04 \leqq (Ta+2\times Nb) \leqq 0.3\%$ by weight.

16. The high-strength, soft-magnetic iron-cobalt-vanadium alloy as claimed in claim 1, wherein the nickel content is $Ni \leqq 1\%$ by weight.

17. The high-strength, soft-magnetic iron-cobalt-vanadium alloy as claimed in claim 1, wherein the nickel content is $Ni \leqq 0.5\%$ by weight.

18. The high-strength, soft-magnetic iron-cobalt-vanadium alloy as claimed in claim 1, wherein the content of melting-related and/or incidental metallic impurities is $Cu \leqq 0.2 Cr \leqq 0.3$, $Mo \leqq 0.3$, $Si \leqq 0.5$, $Mn \leqq 0.3$ and $Al \leqq 0.3$.

19. The high-strength, soft-magnetic iron-cobalt-vanadium alloy as claimed in claim 1, wherein the content of melting-related and/or incidental metallic impurities is $Cu \leqq 0.1 Cr \leqq 0.2$, $Mo \leqq 0.2$, $Si \leqq 0.2$, $Mn \leqq 0.2$ and $Al \leqq 0.2$.

20. The high-strength, soft-magnetic iron-cobalt-vanadium alloy as claimed in claim 1, wherein the content of melting-related and/or incidental metallic impurities is $Cu \leqq 0.06$, $Cr \leqq 0.1$, $Mo \leqq 0.1$, $Si \leqq 0.1$ and $Mn \leqq 0.1$.

21. The high-strength, soft-magnetic iron-cobalt-vanadium alloy as claimed in claim 1, wherein the content of melting-related and/or incidental nonmetallic impurities is $P \leqq 0.01$, $S \leqq 0.02$, $N \leqq 0.005$, $O \leqq 0.05$ and $C \leqq 0.05$.

22. The high-strength, soft-magnetic iron-cobalt-vanadium alloy as claimed in claim 1, wherein the content of melting-related and/or incidental nonmetallic impurities is $P \leqq 0.005$, $S \leqq 0.01$, $N \leqq 0.002$, $O \leqq 0.02$ and $C \leqq 0.02$.

23. The high-strength, soft-magnetic iron-cobalt-vanadium alloy as claimed in claim 1, wherein the content of melting-related and/or incidental nonmetallic impurities is $S \leqq 0.005$, $N \leqq 0.001$, $O \leqq 0.01$ and $C \leqq 0.01$.

* * * * *